US010693227B2

(12) United States Patent
Igura

(10) Patent No.: US 10,693,227 B2
(45) Date of Patent: Jun. 23, 2020

(54) PATCH ARRAY ANTENNA, DIRECTIVITY CONTROL METHOD THEREFOR AND WIRELESS DEVICE USING PATCH ARRAY ANTENNA

(71) Applicant: NEC Corporation, Minato-ku, Tokyo (JP)

(72) Inventor: Hiroyuki Igura, Tokyo (JP)

(73) Assignee: NEC CORPORATION, Tokyo (JP)

( * ) Notice: Subject to any disclaimer, the term of this patent is extended or adjusted under 35 U.S.C. 154(b) by 257 days.

(21) Appl. No.: 15/766,895

(22) PCT Filed: Oct. 11, 2016

(86) PCT No.: PCT/JP2016/004536

§ 371 (c)(1),
(2) Date: Apr. 9, 2018

(87) PCT Pub. No.: WO2017/064856

PCT Pub. Date: Apr. 20, 2017

(65) Prior Publication Data

US 2019/0067813 A1 Feb. 28, 2019

(30) Foreign Application Priority Data

Oct. 14, 2015 (JP) ..... 2015-202636

(51) Int. Cl.
*H01Q 3/26* (2006.01)
*H01Q 3/36* (2006.01)
(Continued)

(52) U.S. Cl.
CPC ..... *H01Q 3/26* (2013.01); *H01Q 3/36* (2013.01); *H01Q 21/065* (2013.01); *H01Q 21/22* (2013.01)

(58) Field of Classification Search
CPC ..... H01Q 3/26; H01Q 3/2605; H01Q 3/2611; H01Q 3/2617; H01Q 3/2623;
(Continued)

(56) References Cited

U.S. PATENT DOCUMENTS 5,422,649 A * 6/1995 Huang ..... H01Q 21/0075 343/700 MS
6,043,790 A * 3/2000 Derneryd ..... H01Q 3/26 342/368

(Continued)

FOREIGN PATENT DOCUMENTS

JP H05-048322 A 2/1993
JP H06-152234 A 5/1994

(Continued)

OTHER PUBLICATIONS

International Search Report for PCT Application No. PCT/JP2016/004536, dated Dec. 27, 2016.

(Continued)

*Primary Examiner* — Daniel Munoz
*Assistant Examiner* — Patrick R Holecek

(57) ABSTRACT

To provide a patch array antenna that allows a limited increase in active component even if the number of antenna elements increases, in a first unequal distribution circuit 106, a first distribution ratio of the power of a first high-frequency signal to be distributed from a first feeding point 108 to first to Nth antenna elements is set to be one of monotone increasing and monotone decreasing with respect to a row of the first to Nth antenna elements. In a second unequal distribution circuit 107, a second distribution ratio of the power of a second high-frequency signal to be distributed from a second feeding point 109 to the first to Nth antenna elements is set to be the other of monotone increasing and monotone decreasing with respect to the row of the first to Nth antenna elements. Directivity is controlled by changing (Continued)

a phase difference between the first and second high-frequency signals.

10 Claims, 15 Drawing Sheets

(51) Int. Cl.
*H01Q 21/22* (2006.01)
*H01Q 21/06* (2006.01)

(58) Field of Classification Search
CPC .. H01Q 3/2652; H01Q 3/2682; H01Q 3/2694; H01Q 3/28; H01Q 3/30; H01Q 3/32; H01Q 3/34; H01Q 3/36; H01Q 3/38; H01Q 3/385; H01Q 3/40; H01Q 3/42; H01Q 3/44; H01Q 21/065; H01Q 21/22; H01Q 21/29
See application file for complete search history.

(56) References Cited

U.S. PATENT DOCUMENTS 6,052,086 A * 4/2000 Kudoh ..... H01Q 21/065 343/700 MS
6,288,678 B1 * 9/2001 Giannetti ..... H01Q 1/32 342/359
6,989,793 B2 * 1/2006 Van Der Poel ..... H01Q 9/0414 343/700 MS
8,604,981 B2 * 12/2013 Ehlen ..... H01Q 21/0087 343/700 MS
9,215,622 B1 * 12/2015 Kinamon ..... H04B 7/0857
2006/0160514 A1 7/2006 Shoji et al.
2009/0309799 A1 12/2009 Hossain
2010/0295729 A1 11/2010 Nogami
2011/0102287 A1 5/2011 Noguchi et al.
2014/0266897 A1 9/2014 Jakoby et al.
2016/0006132 A1 * 1/2016 Lee ..... H01Q 21/065 343/835

FOREIGN PATENT DOCUMENTS

JP H07-288417 A 10/1995
JP H07-307618 A 11/1995
JP 2001-518265 A 10/2001
JP 2002-261503 A 9/2002
JP 2005-253043 A 9/2005
JP 2009-303165 A 12/2009
JP 2012-117959 A 6/2012
JP 2014-531843 A 11/2014
WO 2005/011148 A1 2/2005
WO 2009/107601 A1 9/2009
WO 2010/004739 A1 1/2010

OTHER PUBLICATIONS

English translation of Written opinion for PCT Application No. PCT/JP2016/004536.

* cited by examiner

PATCH ARRAY ANTENNA, DIRECTIVITY CONTROL METHOD THEREFOR AND WIRELESS DEVICE USING PATCH ARRAY ANTENNA

This application is a National Stage Entry of PCT/JP2016/004536 filed on Oct. 11, 2016, which claims priority from Japanese Patent Application 2015-202636 filed on Oct. 14, 2015, the contents of all of which are incorporated herein by reference, in their entirety.

TECHNICAL FIELD

The present invention relates to a patch array antenna, a directivity control method therefor, a wireless device using a patch array antenna, and a two-dimensional array antenna.

BACKGROUND ART

As one type of an antenna used in a high-frequency band equal to or more than a microwave, there is a patch antenna.

The patch antenna is referred to also as a microstrip antenna and is a generic term for antennas formed by using a conductor subjected to printed wiring on a dielectric substrate. The patch antenna features low production cost.

An antenna in which high directivity is produced by arranging a plurality of antenna elements on a planar surface is specifically referred to as a patch array antenna among various types of patch antennas. In a patch array antenna, a signal having a phase or an amplitude different for each antenna element thereof is provided, and thereby directivity can be changed. Therefore, a patch array antenna is often used for military applications in old times and for an antenna for a car radar and the like in recent years.

As a method for controlling directivity of a patch array antenna, a method in which each antenna element of a patch array antenna is connected with a phase shifter and a variable attenuator and these are controlled is most common.

PTL 1 illustrates, in FIG. 1 thereof, for example, a phased array antenna used as an antenna to be tested (a transmission antenna). The illustrated phased array antenna includes first to Mth (M is an integer equal to or more than 2) antenna elements, first to Mth variable attenuators, and first to Mth phase shifters, connected to the elements, respectively. The phased array antenna further includes a variable attenuator control circuit and a phase shifter control circuit. The variable attenuator control circuit controls each variable attenuator. The phase shifter control circuit controls each phase shifter.

Further, PTL 2 illustrates, in FIG. 4 thereof, a receiver used for a millimeter wave band wireless communication system. The illustrated receiver includes a plurality of unit reception circuits of an intermediate frequency (IF) band, including a plurality of antenna elements, respectively, and a plurality of variable attenuators and a plurality of variable phase shifters connected to these circuits, respectively. A control circuit, not illustrated, controls each variable phase shifter by a phase control signal and controls each variable attenuator by an amplitude control signal.

Further, PTL 3 illustrates, in FIG. 1 thereof, a small-size array antenna in which a direction of a beam of a radio wave is variable. The illustrated array antenna includes a plurality of antenna elements arranged on a substrate, a plurality of variable phase shifters connected to these elements, respectively, and a controller connected to each variable phase shifter. The controller controls each variable phase shifter.

In the methods of PTLs 1 to 3 described above, it is necessary to add an active element such as a phase shifter to a radio frequency (RF) circuit for each antenna element. Therefore, in the methods described above, when a directional gain is intended to be improved by increasing the number of antenna elements, active elements such as phase shifters proportional to the number of antenna elements are needed. Therefore, in the methods described above, there is a disadvantage that a circuit size of an RF circuit increases.

As another method for controlling directivity of a patch array antenna, a method for electronically controlling a reactance of a variable reactance element mounted on a dielectric substrate where a patch array antenna is formed has been proposed.

PTL 4 illustrates, in FIG. 1 thereof, for example, an array antenna device capable of electrically switching directivity. The illustrated array antenna device includes first to third slots formed parallel to one another on a conductor formed on a dielectric substrate, a power feeding unit mounted on each of the first to third slots, and first and second varactor diodes. The array antenna device changes capacitances of the first and second varactor diodes, and thereby controls directivity.

Further, PTL 5 illustrates, in FIG. 1 thereof, a planar array antenna including a single layer configuration. The illustrated array antenna device includes an active element formed on a dielectric substrate and first and second patch elements formed adjacently to the active element. The active element is provided with an RF signal source. First and second parasitic patch elements are connected with first and second variable reactance RF units, respectively. In the planar array antenna, reactances of the first and second variable reactance RF units are electronically changed, and thereby directivity is changed.

Further, PTL 6 illustrates, in FIG. 23A thereof, a variable directivity antenna device in which two antenna elements are formed on a dielectric substrate and a parasitic element connected with a P-intrinsic-N (PIN) diode is formed adjacently thereto. In the antenna device, whether or not the PIN diode is grounded is controlled, and thereby directivity is controlled.

In the methods of PTLs 4 to 6 described above, a circuit that controls directivity is formed on a dielectric substrate where an antenna is formed, and therefore a circuit size of an RF circuit itself does not increase. However, in the methods of PTLs 4 to 6, it is necessary to mount variable reactance elements proportional to the number of antenna elements on a dielectric substrate where an antenna is formed. Therefore, in the methods of PTLs 4 to 6, there is a disadvantage that, when a high directivity gain is intended to be obtained by increasing the number of antenna elements, a cost of an antenna increases.

As another method for controlling directivity of a patch array antenna, a method for controlling directivity by changing a position of a dielectric component has been proposed. In the method, a dielectric component is disposed on a microstrip line formed on a dielectric substrate and a position of the dielectric component is physically moved, whereby a phase of a signal passing through the microstrip line is changed. Thereby, directivity of a patch array antenna is changed.

PTL 7 illustrates, in FIG. 7 thereof, for example, an array antenna using a phase shift device capable of easily changing directivity. The illustrated array antenna includes two patch antennas, a power feeding line connected with these antennas, and a dielectric phase shifter disposed in a vicinity of the dielectric line.

The dielectric phase shifter includes a dielectric and a movement mechanism that moves the dielectric. In the array antenna, the dielectric is moved and thereby a phase of the patch antenna is changed, whereby directivity is changed.

In the method described in PTL 7, there is a disadvantage that it is necessary to physically move a dielectric component and therefore durability of a dielectric phase shifter is low.

As another method for controlling directivity of a patch array antenna, a method using a variable dielectric substrate has been proposed.

PTL 8 proposes, for example, an array antenna based on a phase shifter adjustable by a voltage, in which a low-loss dielectric material is adjusted by an applied voltage. In the proposed array antenna, a dielectric substrate is formed by using a material in which permittivity is electrically variable, and a phase of a signal passing through a microstrip line formed on the dielectric substrate is changed by controlling an applied voltage to the dielectric substrate. Thereby, directivity is changed. PTL 8 exemplifies barium strontium titanate, a liquid crystal, and the like as a material in which permittivity is electrically variable.

In the method of PTL 8, there is a disadvantage that it is necessary to use a special material for a dielectric substrate.

As another method for controlling directivity of a patch array antenna, a method using a variable power distributor has been proposed.

PTL 9 illustrates, in FIGS. 1 and 3 thereof, for example, a directivity variable antenna in which a power applied to each circular array of circular arrays formed double is changed by using a variable power distributor and thereby directivity is changed.

Further, PTL 10 has proposed an array antenna capable of controlling a polarization plane while not being a technique for controlling directivity. In the proposed array antenna, similarly to PTL 9, by using a variable power distributor, a distribution ratio of signal powers input from two power feeding points connected with a plurality of antenna elements is changed. Thereby, a polarization plane is controlled.

CITATION LIST

Patent Literature

[PTL 1] Japanese Laid-open Patent Publication No. 2012-117959

[PTL 2] International Publication No. WO 2005/011148

[PTL 3] International Publication No. WO 2009/107601

[PTL 4] Japanese Laid-open Patent Publication No. 2005-253043

[PTL 5] Japanese Laid-open Patent Publication No. 2009-303165

[PTL 6] International Publication No. WO 2010/004739

[PTL 7] Japanese Laid-open Patent Publication No. 2002-261503

[PTL 8] Japanese Translation of PCT International Application Publication No. 2014-531843

[PTL 9] Japanese Laid-open Patent Publication No. H7-288417

[PTL 10] Japanese Laid-open Patent Publication No. H7-307618

SUMMARY OF INVENTION

Technical Problem

In the above-described methods for controlling directivity of a patch array antenna, there are problems described below, respectively.

The techniques disclosed by PTLs 1 to 3 change a phase and an amplitude of a signal of an individual antenna element by connecting an active component such as a phase shifter to each individual antenna element. Therefore, in the techniques, there is a problem that, when the number of antenna elements is increased in order to improve a directional gain, the number of the active components increases depending on the increase, and therefore a cost for an antenna and a mounting area increase.

The techniques disclosed by PTLs 4 to 6 control directivity by mounting, depending on the number of antenna elements, a plurality of variable reactance elements on a dielectric substrate constituting an antenna. Therefore, in the techniques, there is a problem that, when the number of antenna elements is increased, the number of variable reactance elements mounted on an antenna increases, and therefore a cost for the antenna increases.

The technique disclosed by PTL 7 changes a phase of a signal of each antenna element by physically moving a dielectric component disposed on a microstrip line. However, in the technique, there is a problem that durability of a movement mechanism for physically moving a dielectric component is low.

The technique disclosed by PTL 8 needs to use a dielectric substrate based on a special material in which permittivity is electrically variable. However, in the technique, there is a problem that it is difficult to obtain such a dielectric substrate, which therefore affects a device cost.

The technique disclosed by PTL 9 changes directivity by changing a distribution ratio of powers applied to a plurality of circular arrays, respectively, by using a variable power distributor. However, in the technique, it is necessary to use an array where a plurality of antenna elements are circularly arranged, and therefore there is a problem that a disposition density of antenna elements is low and an antenna is large.

While being similar to the technique disclosed by PTL 9, the technique disclosed by PTL 10 is not a technique for controlling directivity but a technique for controlling a polarization plane.

In view of problems as described above, an object of the present invention is to provide a patch array antenna and a directivity control method therefor that solve any one of the above-described problems.

The present invention is further intended to provide a wireless device using the patch array antenna, and a two-dimensional array antenna.

Solution to Problem

According to a first aspect of the present invention, provided is a patch array antenna including:

first to Nth (N is an integer equal to or more than 3) antenna elements being formed side by side on a dielectric substrate in a first direction;

a first unequal distribution circuit that is formed on the dielectric substrate in the first direction adjacently to the first to Nth antenna elements on a first side and distributes a first high-frequency signal fed from a first power feeding point to the first to Nth antenna elements; and a second unequal distribution circuit that is formed on the dielectric substrate in the first direction adjacently to the first to Nth antenna elements on a second side opposite to the first side and distributes a second high-frequency signal fed from a second power feeding point to the first to Nth antenna elements, wherein, in the first unequal distribution circuit, a first distribution ratio of a power of the first high-frequency signal to be distributed from the first power feeding point to the first to Nth antenna elements is set to be one of monotone increasing and monotone decreasing with respect to a row of the first to Nth antenna elements, in the second unequal distribution circuit, a second distribution ratio of a power of the second high-frequency signal to be distributed from the second feeding point to the first to Nth antenna elements is set to be the other of monotone increasing and monotone decreasing with respect to the row of the first to Nth antenna elements, and directivity is controlled by changing a phase difference between the first and second high-frequency signals.

According to a second aspect of the present invention, provided is a directivity control method for a patch array antenna including:

first to Nth (N is an integer equal to or more than 3) antenna elements being formed side by side on a dielectric substrate in a first direction;

a first unequal distribution circuit that is formed on the dielectric substrate in the first direction adjacently to the first to Nth antenna elements on a first side and distributes a first high-frequency signal fed from a first power feeding point to the first to Nth antenna elements; and a second unequal distribution circuit that is formed on the dielectric substrate in the first direction adjacently to the first to Nth antenna elements on a second side opposite to the first side and distributes a second high-frequency signal fed from a second power feeding point to the first to Nth antenna elements, the method including:

setting, in the first unequal distribution circuit, a first distribution ratio of a power of the first high-frequency signal to be distributed from the first power feeding point to the first to Nth antenna elements, to be one of monotone increasing and monotone decreasing with respect to a row of the first to Nth antenna elements; setting, in the second unequal distribution circuit, a second distribution ratio of a power of the second high-frequency signal to be distributed from the second feeding point to the first to Nth antenna elements, to be the other of monotone increasing and monotone decreasing with respect to the row of the first to Nth antenna elements; and controlling directivity by changing a phase difference between the first and second high-frequency signals.

According to a third aspect of the present invention, provided is a wireless device including: a control unit; the patch array antenna described in the first aspect; and first and second RF circuits connected between the first and second power feeding points of the patch array antenna and the control unit, respectively, wherein a phase difference between the first and second high-frequency signals to be provided to the first and second power feeding points is changed by the control unit through the first and second RF circuits.

According to a fourth aspect of the present invention, provided is a wireless device including: a control unit; the patch array antenna described in the first aspect; first and second phase shifters one end sides of which are connected to the first and second power feeding points of the patch array antenna, respectively; and an RF circuit commonly connected between the other end sides of the first and second phase shifters and the control unit, wherein a phase difference between the first and second high-frequency signals to be provided to the first and second power feeding points is changed by controlling the first and second phase shifters by the control unit.

According to a fifth aspect of the present invention, provided is a two-dimensional array antenna including first to Lth (L is an integer equal to or more than 3) patch array antennas obtained by disposing the patch array antenna described in the first aspect side by side on a dielectric substrate in a second direction orthogonal to the first direction, the two-dimensional array antenna including: L of the first power feeding points arranged in the second direction adjacently to the first to Lth patch array antennas on a third side parallel to the second direction; and L of the second power feeding points arranged in the second direction adjacently to the first to Lth patch array antennas on a fourth side opposite to the third side, the two-dimensional array antenna further including:

a third unequal distribution circuit that is formed along one side of both sides along the L first power feeding points and distributes a third high-frequency signal fed from a third power feeding point to the L first power feeding points;

a fourth unequal distribution circuit that is formed along the other side of both sides along the L first power feeding points and distributes a fourth high-frequency signal fed from a fourth power feeding point to the L first power feeding points;

a fifth unequal distribution circuit that is formed along one side of both sides along the L second power feeding points and distributes a fifth high-frequency signal fed from a fifth power feeding point to the L second power feeding points; and a sixth unequal distribution circuit that is formed along the other side of both sides along the L second power feeding points and distributes a sixth high-frequency signal fed from a sixth power feeding point to the L second power feeding points, wherein a distributed signal of the third high-frequency signal from the third unequal distribution circuit and a distributed signal of the fourth high-frequency signal from the fourth unequal distribution circuit are synthesized at the L first power feeding points, respectively, and fed to the first to Lth patch array antennas as the first high-frequency signal, a distributed signal of the fifth high-frequency signal from the fifth unequal distribution circuit and a distributed signal of the sixth high-frequency signal from the sixth unequal distribution circuit are synthesized at the L second power feeding points, respectively, and fed to the first to Lth patch array antennas as the second high-frequency signal, and a phase difference between the third and fourth high-frequency signals from the third and fourth power feeding points and a phase difference between the fifth and sixth high-frequency signals from the fifth and sixth power feeding points are changed.

Advantageous Effects of Invention

According to the present invention, it is possible to provide a patch array antenna being capable of electrically controlling directivity, and having high durability and realizing a low cost in which, even when the number of antenna elements increases, an increase of the number of active components is limited.

DESCRIPTION OF EMBODIMENTS

An example embodiment of the present invention will be described with reference to the accompanying drawings.

First, a configuration of a patch array antenna according to the example embodiment of the present invention will be described.

Figure 1:
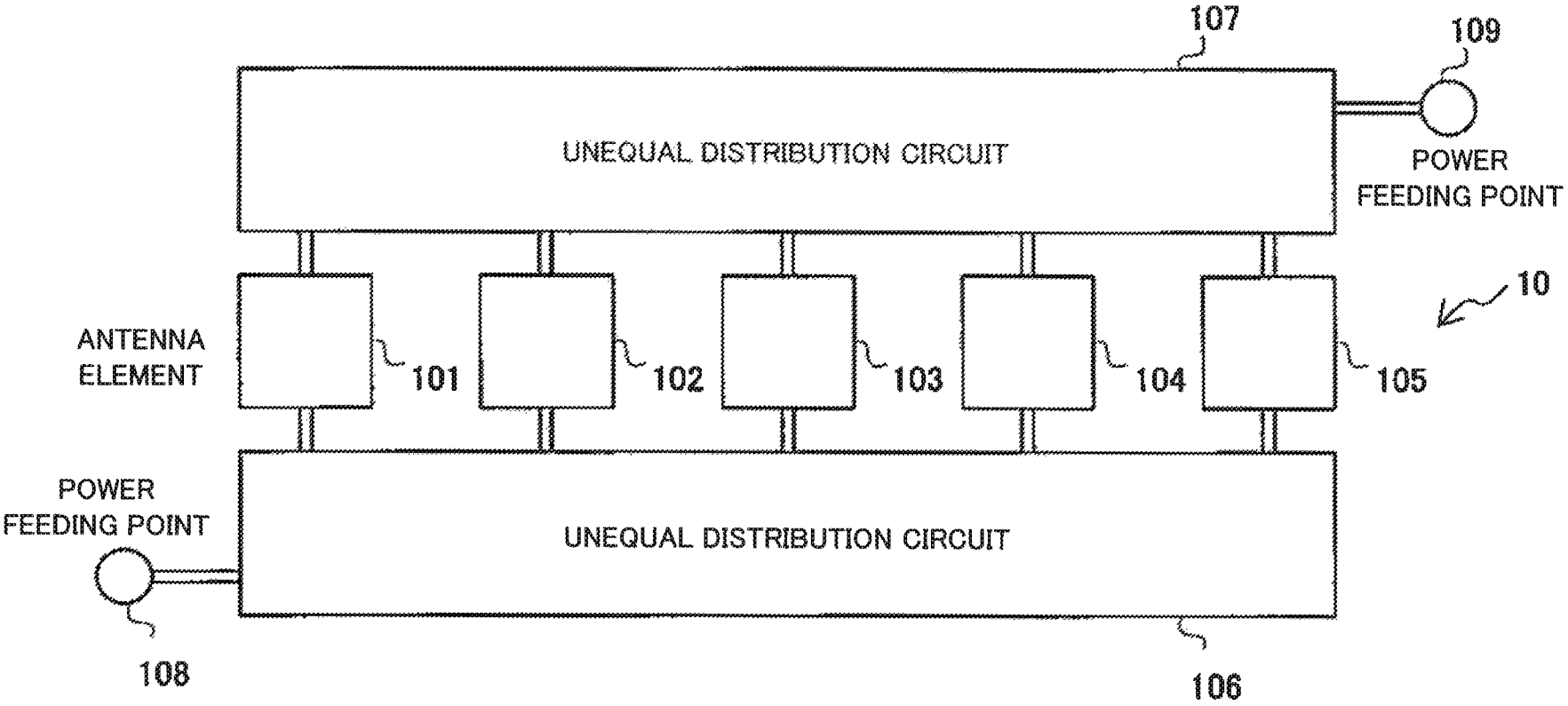
FIG. 1 is a block diagram illustrating a configuration of a patch array antenna according to an example embodiment of the present invention.

FIG. 1 is a block diagram illustrating a configuration of the patch array antenna according to the example embodiment of the present invention. A patch array antenna 10 according to the present example embodiment includes first to fifth antenna elements 101 to 105, first and second unequal distribution circuits 106 and 107, and first and second power feeding points 108 and 109. The first and second unequal distribution circuits 106 and 107 are connected to the first to fifth antenna elements 101 to 105. The first and second power feeding points 108 and 109 are connected to the first and second unequal distribution circuits 106 and 107, respectively. These components are commonly formed on a dielectric substrate, but illustration of the dielectric substrate is omitted. This is similar in a patch array antenna to be described in the following description.

As illustrated in FIG. 1, the first to fifth antenna elements 101 to 105 are formed side by side on a dielectric substrate in a first direction (a lateral direction in FIG. 1). The first unequal distribution circuit 106 is formed on the dielectric substrate in the first direction adjacently to the first to fifth antenna elements 101 to 105 on a first side (a lower side in FIG. 1). The second unequal distribution circuit 107 is formed on the dielectric substrate in the first direction adjacently to the first to fifth antenna elements 101 to 105 on a second side (an upper side of FIG. 1) opposite to the first side.

While in FIG. 1, the number of antenna elements N is 5, the number of antenna elements N can be any natural number which is equal to or more than 3.

Each of the first to Nth antenna elements 101 to 105 includes a conductive flat plate on a dielectric substrate. Further, each of the first and second unequal distribution circuits 106 and 107 includes a microstrip line formed on the dielectric substrate. Wiring between the first power feeding point 108 and the first unequal distribution circuit 106 and wiring between the second power feeding point 109 and the second unequal distribution circuit 107 include a microstrip line. Further, wiring between the first unequal distribution circuit 106 and the first to fifth antenna elements 101 to 105 and wiring between the second unequal distribution circuit 107 and the first to fifth antenna elements 101 to 105 also include a microstrip line.

The first and second power feeding points 108 and 109 are provided with first and second high-frequency signals (input signals) having the same frequency and amplitude and different phases, respectively, from an outside of the patch array antenna 10.

The first high-frequency signal provided to the first power feeding point 108 is distributed to the first to Nth antenna elements 101 to 105 as described later through the first unequal distribution circuit 106. Similarly, the second high-frequency signal provided to the second power feeding point 109 is distributed to the first to Nth antenna elements 101 to 105 as described later through the second unequal distribution circuit 107.

From the first unequal distribution circuit 106, a first high-frequency signal is distributed and fed to one end (a lower end in FIG. 1) side of the first to fifth antenna elements 101 to 105. From the second unequal distribution circuit 107, a second high-frequency signal is distributed and fed to the other end (an upper end in FIG. 1) side of the first to fifth antenna elements 101 to 105.

A distribution ratio (hereinafter, referred to as a first distribution ratio) of a power of a first high-frequency signal distributed from the first unequal distribution circuit 106 to the first to fifth antenna elements 101 to 105 can be fixedly determined according to a pattern of a first micro strip line configuring the first unequal distribution circuit 106 as described later. Similarly, a distribution ratio (hereinafter, referred to as a second distribution ratio) of a power of a second high-frequency signal distributed from the second unequal distribution circuit 107 to the first to fifth antenna elements 101 to 105 can be fixedly determined according to a pattern of a second microstrip line configuring the second unequal distribution circuit 107 as described later. The first and second high-frequency signals are distributed in such a way that the first and second distribution ratios are set to be monotone increasing or monotone decreasing, respectively, with respect to a row of the first to fifth antenna elements 101 to 105.

Specifically, it is assumed that, for example, a first distribution ratio of the first unequal distribution circuit 106 is set to be monotone increasing with respect to a row of the first to fifth antenna elements 101 to 105. In this case, a second distribution ratio of the second unequal distribution circuit 107 is set to be monotone decreasing with respect to the row of the first to fifth antenna elements 101 to 105. In contrast, it is assumed that a first distribution ratio of the first unequal distribution circuit 106 is set to be monotone decreasing with respect to a row of the first to fifth antenna elements 101 to 105. In this case, a second distribution ratio of the second unequal distribution circuit 107 is set to be monotone increasing with respect to the row of the first to fifth antenna elements 101 to 105.

A first high-frequency signal distributed from the first unequal distribution circuit 106 to the first to fifth antenna elements 101 to 105 and a second high-frequency signal distributed from the second unequal distribution circuit 107 to the first to fifth antenna elements 101 to 105 are synthesized and emitted by the first to fifth antenna elements 101 to 105 as described later.

Figure 2:
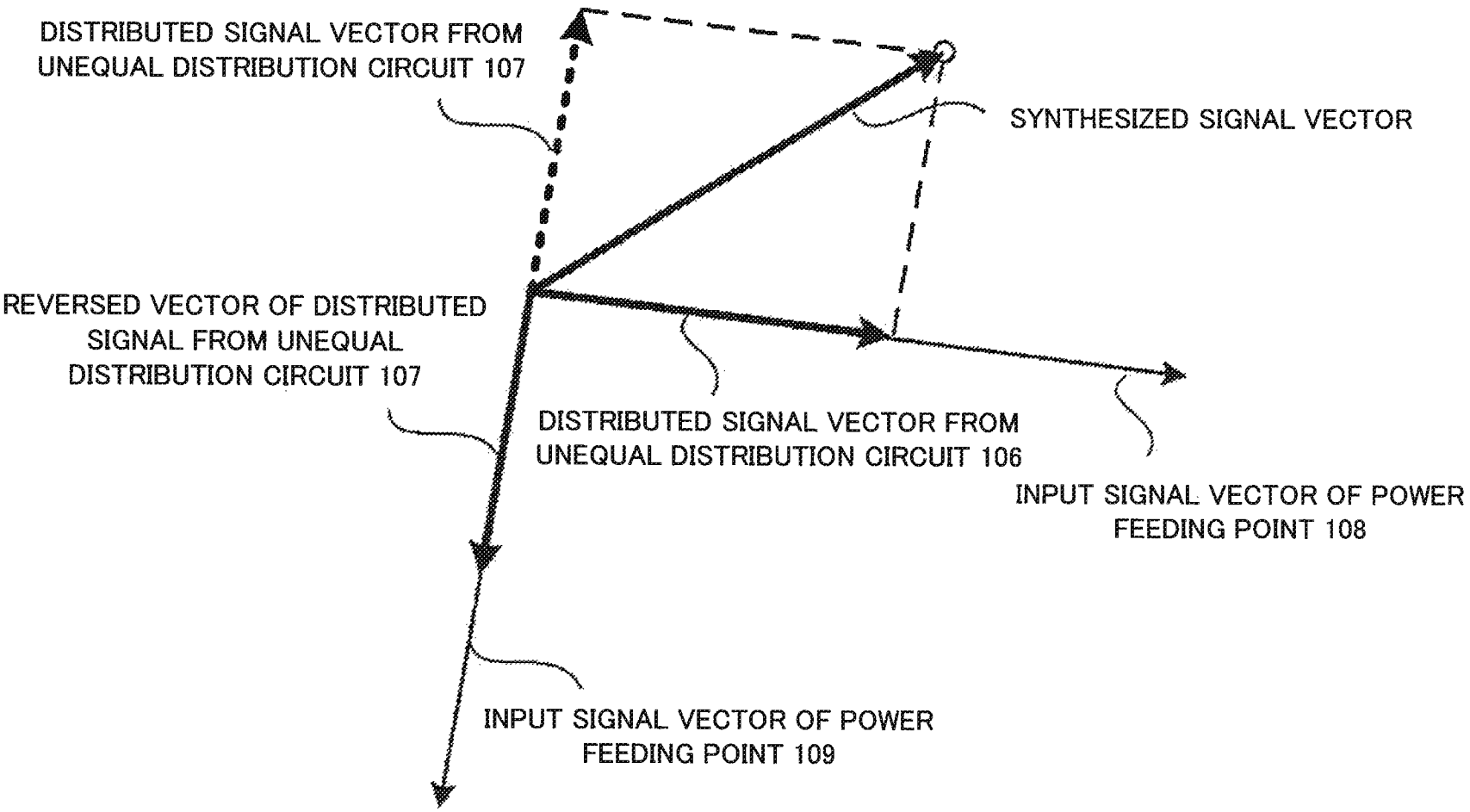
FIG. 2 is a diagram illustrating a relation between input signals of two power feeding points in the patch array antenna illustrated in FIG. 1 and a synthesized signal obtained from one antenna element.

FIG. 2 illustrates, in vector notation, a relation in phase and amplitude between first and second high-frequency signals fed to one antenna element from the first and second unequal distribution circuits 106 and 107 illustrated in FIG. 1 and a synthesized high-frequency signal obtained by synthesizing the first and second high-frequency signals in the one antenna element. A direction of a vector illustrated in FIG. 2 indicates a phase of a high-frequency signal, and a length of a vector indicates an amplitude of a high-frequency signal.

When an influence of a propagation delay is neglected, a first distributed signal vector from the first unequal distribution circuit 106 has the same phase as a phase of an input signal vector of the first power feeding point 108 and is a vector having an amplitude square-root times a first distribution ratio. Similarly, a second distributed signal vector from the second unequal distribution circuit 107 has the same phase as a phase of an input signal vector of the second power feeding point 109 and is a vector having an amplitude square-root times a second distribution ratio. First and second distributed signals from the first and second unequal distribution circuits 106 and 107 are synthesized in an antenna element and become a synthesized high-frequency signal. However, as illustrated in FIG. 1, a second distributed signal from the second unequal distribution circuit 107 is fed to an antenna element from a direction opposite to a direction of a first distributed signal from the first unequal distribution circuit 106, and therefore a phase is reversed. As a result, a synthesized signal vector obtained by synthesizing first and second distributed signals in an antenna element becomes a signal in which a first distributed signal vector from the first unequal distribution circuit 106 and a reversed vector (illustrated by a dotted line in FIG. 2) of a second distributed signal vector from the second unequal distribution circuit 107 are added.

A distribution ratio of each unequal distribution circuit can be determined using a circular interpolation method or a linear interpolation method to be described below.

First, a method for determining a distribution ratio using a circular interpolation method is described. The following equations (1) and (2) each represent an equation for determining a distribution ratio using a circular interpolation method.

[Math. 1]

$$r_1(k) = \frac{2}{N}\cos^2\left(\frac{\pi}{2}\cdot\frac{k}{(N-1)}\right) \tag{1}$$

[Math. 2]

$$r_2(k) = \frac{2}{N}\sin^2\left(\frac{\pi}{2}\cdot\frac{k}{(N-1)}\right) \tag{2}$$

In equations (1) and (2), N represents the number of antenna elements, and k represents an antenna element number (0 to N−1). The symbol r1(k) represents a first distribution ratio for an antenna element of an antenna element number k from the first unequal distribution circuit 106. The symbol r2(k) represents a second distribution ratio for an antenna element of an antenna element number k from the second unequal distribution circuit 107.

Table 1 described below indicates an example of a distribution ratio (first and second distribution ratios) in which the number of antenna elements N=5. Antenna element numbers 0 to 4 are assigned to the first to fifth antenna elements 101 to 105, respectively. As can be understood from Table 1, each of the first and second distribution ratios includes 0. It is assumed that a first distribution ratio for the fifth antenna element 105 of an antenna element number 4 from the first unequal distribution circuit 106 and a second distribution ratio for the first antenna element 101 of an antenna element number 0 from the second unequal distribution circuit 107 are 0. This is the same as in Table 2 to be described later. In the case of this distribution method, as is clear from Table 1, a total (a total of first and second distribution ratios) of powers of signals provided to respective antenna elements is constant.

TABLE 1

| Antenna element number k | Power distribution Ratio $r_1$ | $r_2$ |
|---|---|---|
| 0 | 0.400 | 0.000 |
| 1 | 0.341 | 0.059 |
| 2 | 0.200 | 0.200 |
| 3 | 0.059 | 0.341 |
| 4 | 0.000 | 0.400 |

Figure 3:
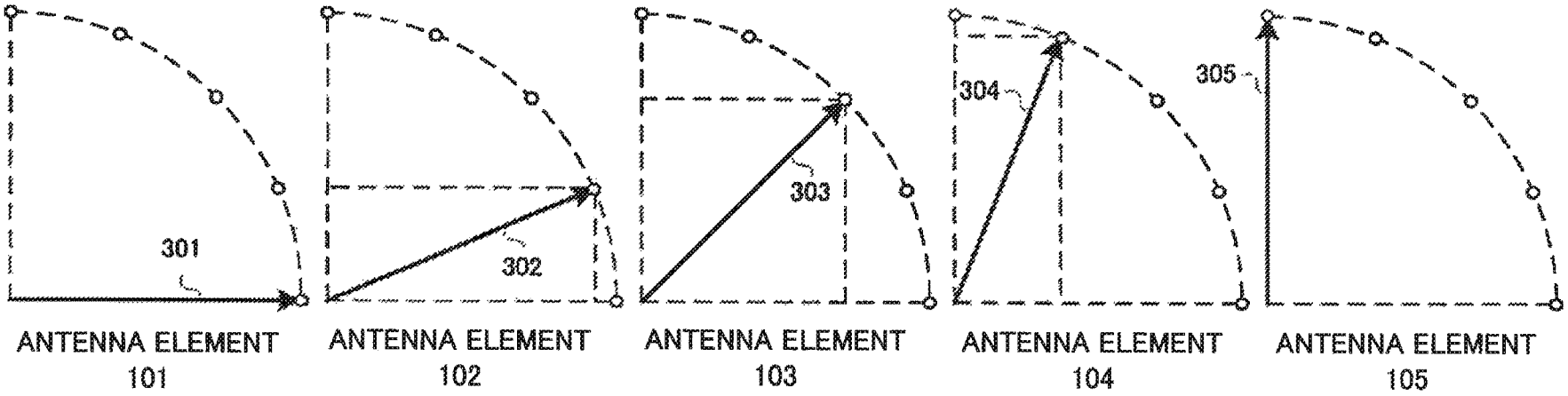
FIG. 3 is a diagram illustrating a synthesized signal obtained from each antenna element by a circular interpolation method in which a phase difference between two input signals is 90 degrees in the patch array antenna illustrated in FIG. 1.
Figure 4:
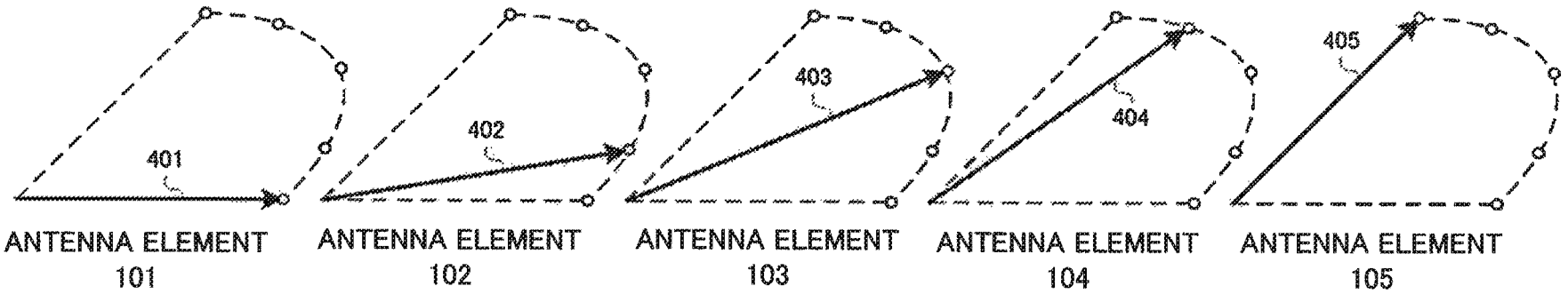
FIG. 4 is a diagram illustrating a synthesized signal obtained from each antenna element by a circular interpolation method in which a phase difference between two input signals is 135 degrees in the patch array antenna illustrated in FIG. 1.

A relation between a phase and an amplitude of a synthesized signal vector in each antenna element in which a circular interpolation method is applied to determine first and second distribution ratios of the first and second unequal distribution circuits 106 and 107 in the patch array antenna 10 of FIG. 1 is illustrated in FIGS. 3 and 4. FIG. 3 illustrates synthesized signal vectors 301 to 305 in the first to fifth antenna elements 101 to 105 in which a phase difference between first and second high-frequency signals of the first and second power feeding points 108 and 109 is 90 degrees. FIG. 4 illustrates synthesized signal vectors 401 to 405 in the first to fifth antenna elements 101 to 105 in which a phase difference between first and second high-frequency signals of the first and second power feeding points 108 and 109 is 135 degrees. In any one of FIGS. 3 and 4, a phase difference between adjacent antenna elements of signals synthesized in the first to fifth antenna elements 101 to 105 is constant (e.g., 22.5 degrees in FIG. 3).

Next, a method for determining a distribution ratio using a linear interpolation method is described. The following equations (3) and (4) each represent an equation for determining a distribution ratio using a linear interpolation method.

[Math. 3]

$$r_1(k) = \frac{(N-1-k)^2}{\sum_{i=0}^{N-1} i^2} \tag{3}$$

[Math. 4]

$$r_2(k) = \frac{k^2}{\sum_{i=0}^{N-1} i^2} \tag{4}$$

In equations (3) and (4), N represents the number of antenna elements, and k represents an antenna element number (0 to N−1). The symbol r1(k) represents a first distribution ratio for an antenna element of an antenna element number k from the first unequal distribution circuit 106. The symbol r2(k) represents a second distribution ratio for an antenna element of an antenna element number k from the second unequal distribution circuit 107.

Table 2 described below indicates an example of a power distribution ratio (first and second distribution ratios) in which the number of antenna elements N=5. In the case of this distribution method, a total of amplitudes of signals provided to respective antenna elements is constant.

TABLE 2

| Antenna element | Power distribution Ratio | |
|---|---|---|
| number k | $r_1$ | $r_2$ |
| 0 | 0.533 | 0.000 |
| 1 | 0.300 | 0.033 |
| 2 | 0.133 | 0.133 |
| 3 | 0.033 | 0.300 |
| 4 | 0.000 | 0.533 |

Figure 5:
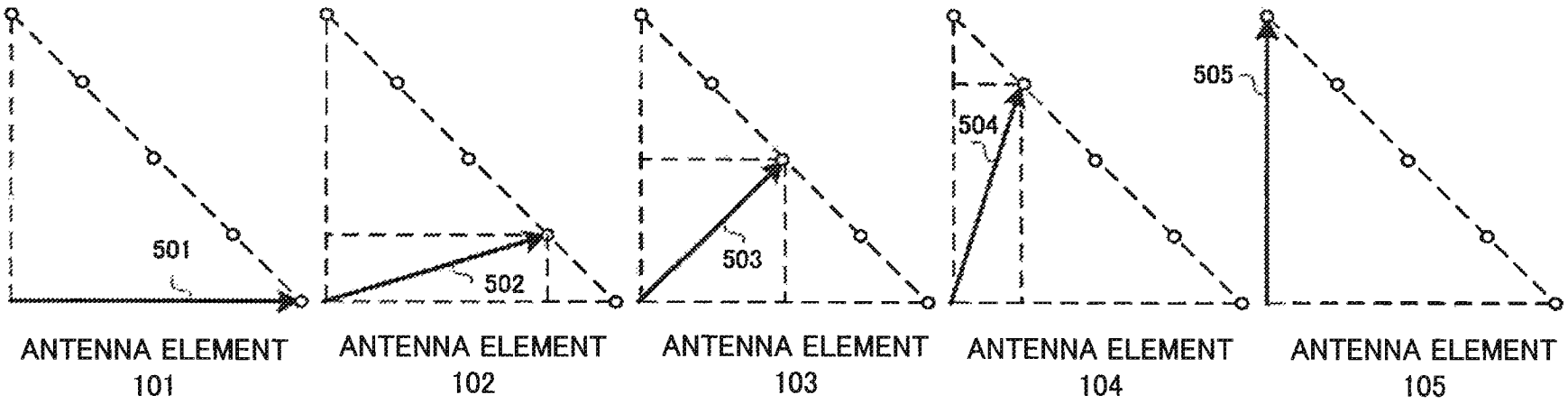
FIG. 5 is a diagram illustrating a synthesized signal obtained from each antenna element by a linear interpolation method when a phase difference between two input signals is 90 degrees in the patch array antenna illustrated in FIG. 1.
Figure 6:
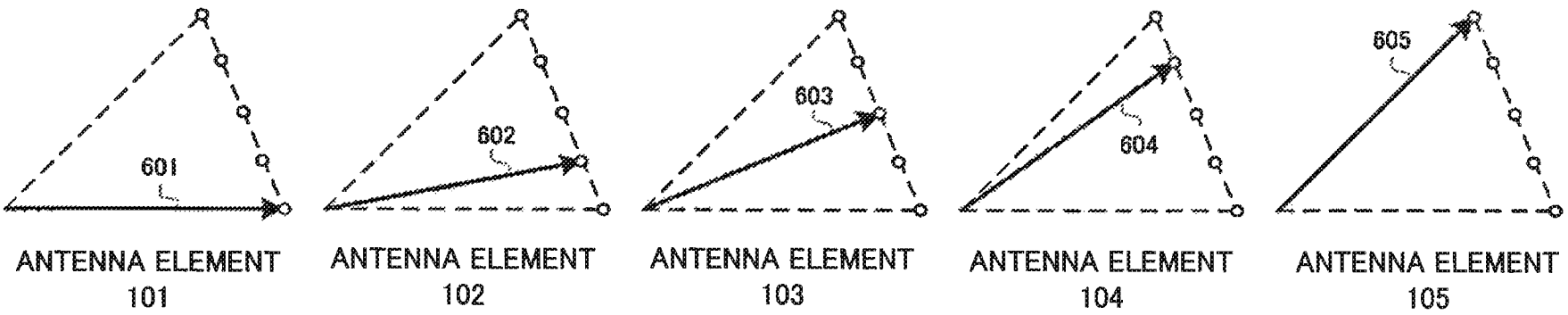
FIG. 6 is a diagram illustrating a synthesized signal obtained from each antenna element by a linear interpolation method when a phase difference between two input signals is 135 degrees in the patch array antenna illustrated in FIG. 1.

A relation between a phase and an amplitude of a synthesized signal vector in each antenna element in which a linear interpolation method is applied to determine first and second distribution ratios of the first and second unequal distribution circuits 106 and 107 in the patch array antenna 10 of FIG. 1 is illustrated in FIGS. 5 and 6. FIG. 5 illustrates synthesized signal vectors 501 to 505 in the first to fifth antenna elements 101 to 105 in which a phase difference between first and second high-frequency signals of the first and second power feeding points 108 and 109 is 90 degrees. FIG. 6 illustrates synthesized signal vectors 601 to 605 in the first to fifth antenna elements 101 to 105 in which a phase difference between first and second high-frequency signals of the first and second power feeding points 108 and 109 is 135 degrees. In any one of FIGS. 5 and 6, a phase difference between adjacent antenna elements of signals synthesized in the first to fifth antenna elements 101 to 105 is constant.

Figure 7:
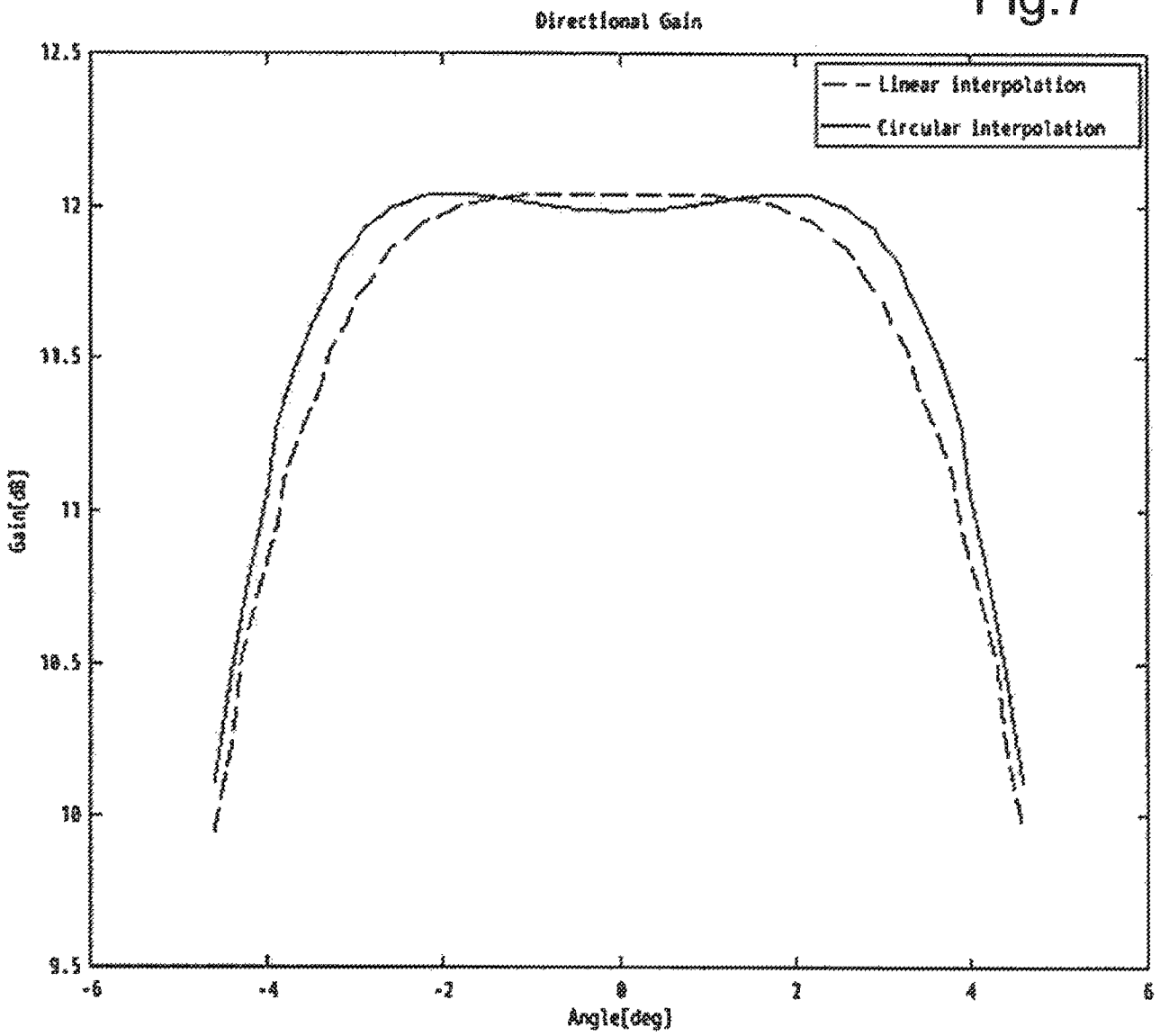
FIG. 7 is a characteristic diagram for illustrating a difference between a directional gain upon using the circular interpolation method illustrated in FIGS. 3 and 4 and a directional gain upon using the linear interpolation method illustrated in FIGS. 5 and 6.

FIG. 7 illustrates, using a graph, a relation between a maximum value of a directional gain of a patch array antenna and a beam directional angle thereof in which a phase difference between first and second high-frequency signals of first and second power feeding points is changed when a distribution ratio (first and second distribution ratios) based on a circular interpolation method is used and when a distribution ratio (first and second distribution ratios) based on a linear interpolation method is used. The number of antenna elements is 16, and characteristics obtained using the circular interpolation method is indicated by a solid line and characteristics obtained using the linear interpolation method is indicated by a dotted line.

As can be seen from the graph of FIG. 7, a phase difference between first and second high-frequency signals of first and second power feeding points is changed, and thereby both a circular interpolation method and a linear interpolation method can perform phase control of approximately 8 degrees. However, it is understood that a phase control angle is wide in a circular interpolation method, compared with a linear interpolation method. On the other hand, a directional gain at a central angle is higher in use of the linear interpolation method.

Figure 8:
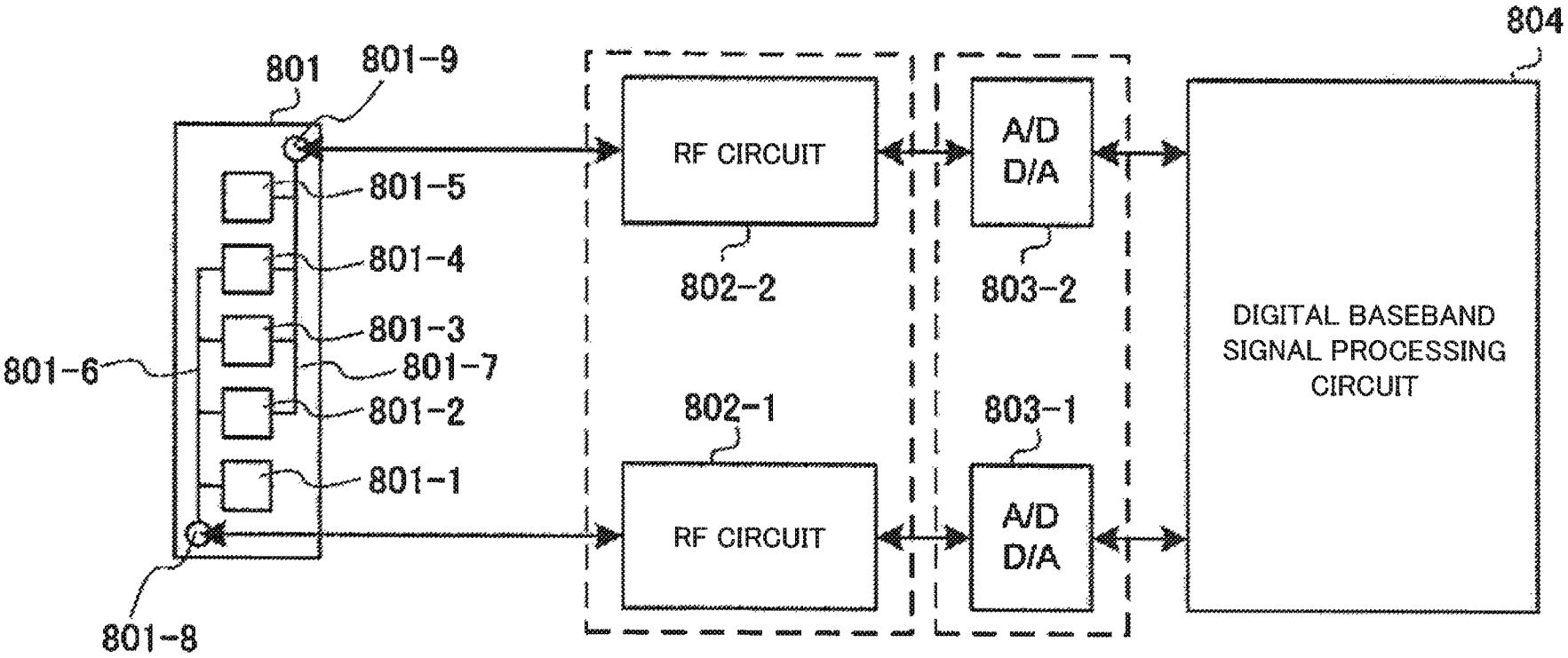
FIG. 8 is a diagram illustrating a configuration example of a wireless device upon using two RF circuits for directivity control of a patch array antenna according to the present invention.
Figure 9:
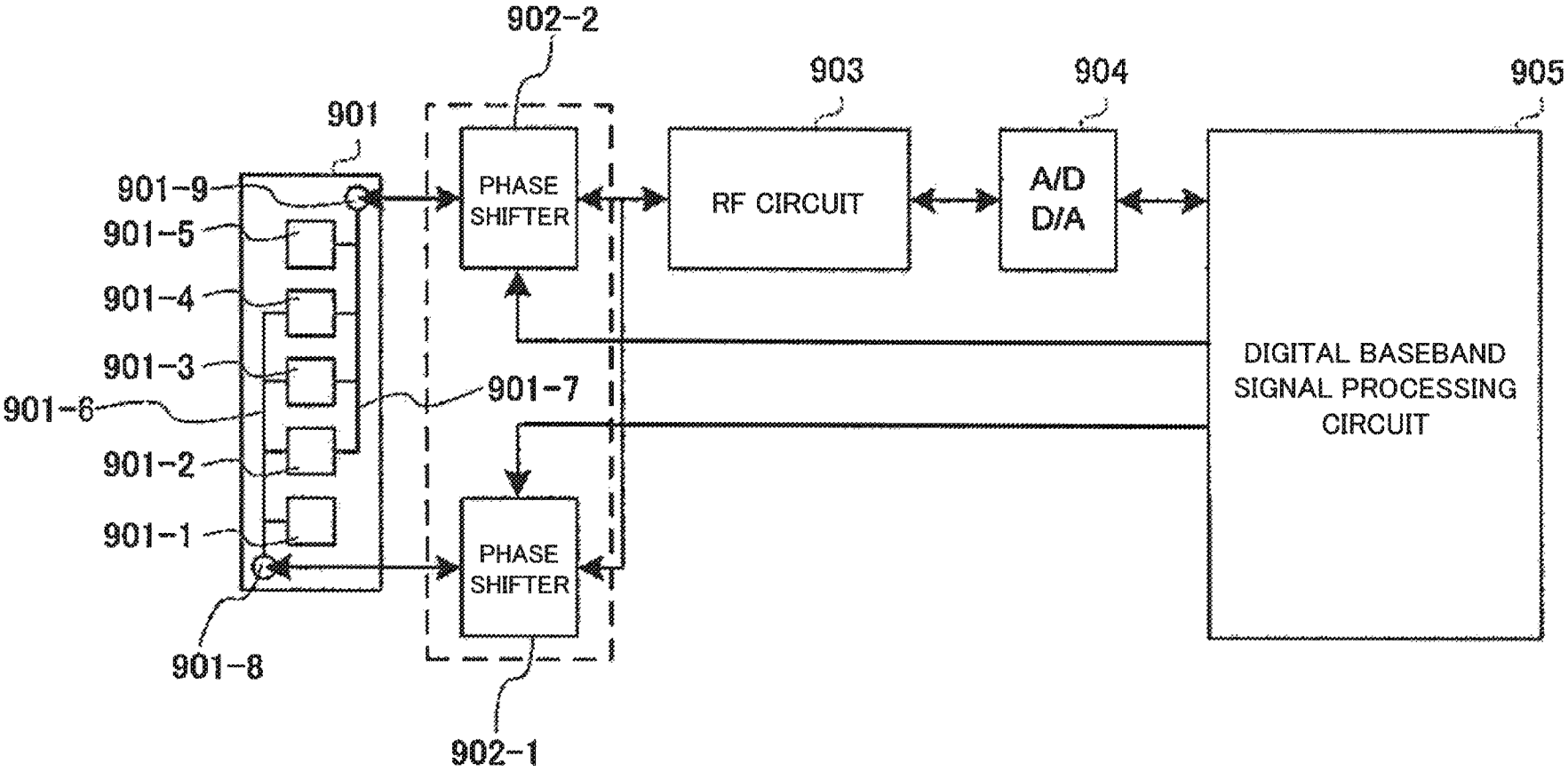
FIG. 9 is a diagram illustrating a configuration example of a wireless device upon using two phase shifters for directivity control of the patch array antenna according to the present invention.

FIGS. 8 and 9 each illustrate a configuration example of a wireless device in which a patch array antenna according to the present invention is used.

In patch array antennas 801 and 901 of FIGS. 8 and 9, illustration of the blocks of the first and second unequal distribution circuits described in FIG. 1 is omitted. The reason is described for FIG. 8 as follows: each of first and second unequal distribution circuits is achieved by a pattern of a microstrip line. As a matter of convenience, in FIG. 8, a pattern of a microstrip line configuring first and second unequal distribution circuits 801-6 and 801-7 is indicated only by a solid line. Further, in the patch array antenna 801 of FIG. 8, a connection form between first and second unequal distribution circuits and first to fifth antenna elements 801-1 to 801-5 is different from the patch array antenna illustrated in FIG. 1. In other words, the first antenna element 801-1 is not connected to a second power feeding point 801-9, and the fifth antenna element 801-5 is not connected to a first power feeding point 801-8. This means that as indicated in Tables 1 and 2, it is unnecessary to provide a high-frequency signal to an antenna element of a distribution ratio (first and second distribution ratios) of 0 and therefore wiring may be omitted. A pattern of a microstrip line will be described later with reference to FIGS. 12 and 13. The above description is also applied to the patch array antenna 901 of FIG. 9.

The wireless device illustrated in FIG. 8 includes a patch array antenna 801, first and second RF circuits 802-1 and 802-2, first and second analog/digital (A/D) converters and D/A converters 803-1 and 803-2, and a digital baseband signal processing circuit (control unit) 804. A series circuit of the first RF circuit 802-1 and the first A/D converter and D/A converter 803-1 is connected between the first power feeding point 801-8 of the patch array antenna 801 and the digital baseband signal processing circuit 804. A series circuit of the second RF circuit 802-2 and the second A/D converter and D/A converter 803-2 is connected between the second power feeding point 801-9 of the patch array antenna 801 and the digital baseband signal processing circuit 804. The wireless device outputs, upon transmission, first and second high-frequency signals having different phases from the digital baseband signal processing circuit 804 to the first and second power feeding points 801-8 and 801-9. In the digital baseband signal processing circuit 804, a phase difference between the first and second high-frequency signals is controlled, and thereby directivity can be controlled. Needless to say, in the control of directivity, distribution of first and second high-frequency signals based on a distribution ratio (first and second distribution ratios) of monotone decreasing or monotone increasing with respect to the first to fifth antenna elements 801-1 to 801-5 also contributes. Description on an operation upon reception is omitted.

The wireless device illustrated in FIG. 9 includes a patch array antenna 901, first and second phase shifters 902-1 and 902-2, an RF circuit 903, an A/D converter and D/A converter 904, and a digital baseband signal processing circuit (control unit) 905. One end side of the first phase shifter 902-1 is connected to a first power feeding point 901-8 of the patch array antenna 901, and one end side of the second phase shifter 902-2 is connected to a second power feeding point 901-9 of the patch array antenna 901. A series circuit of the RF circuit 903 and the A/D converter and D/A converter 904 is connected commonly between the other end sides of the first and second phase shifters 902-1 and 902-2 and the digital baseband signal processing circuit 905. The digital baseband signal processing circuit 905 in the wireless device outputs control signals to the first and second phase shifters 902-1 and 902-2, respectively. As one example of the control signals, cited are voltage control signals for controlling phases of signals output from the first and second phase shifters 902-1 and 902-2 by voltages applied to the first and second phase shifters 902-1 and 902-2, but there is no limitation thereto. The wireless device can control directivity by individually controlling voltages applied to the first and second phase shifters 902-1 and 902-2 by the digital baseband signal processing circuit 905. Similarly to the wireless device of FIG. 8, in the control of directivity, distribution of first and second high-frequency signals based on a distribution ratio (first and second distribution ratios) of monotone decreasing or monotone increasing with respect to the first to fifth antenna elements 901-1 to 901-5 also contributes.

Figure 10:
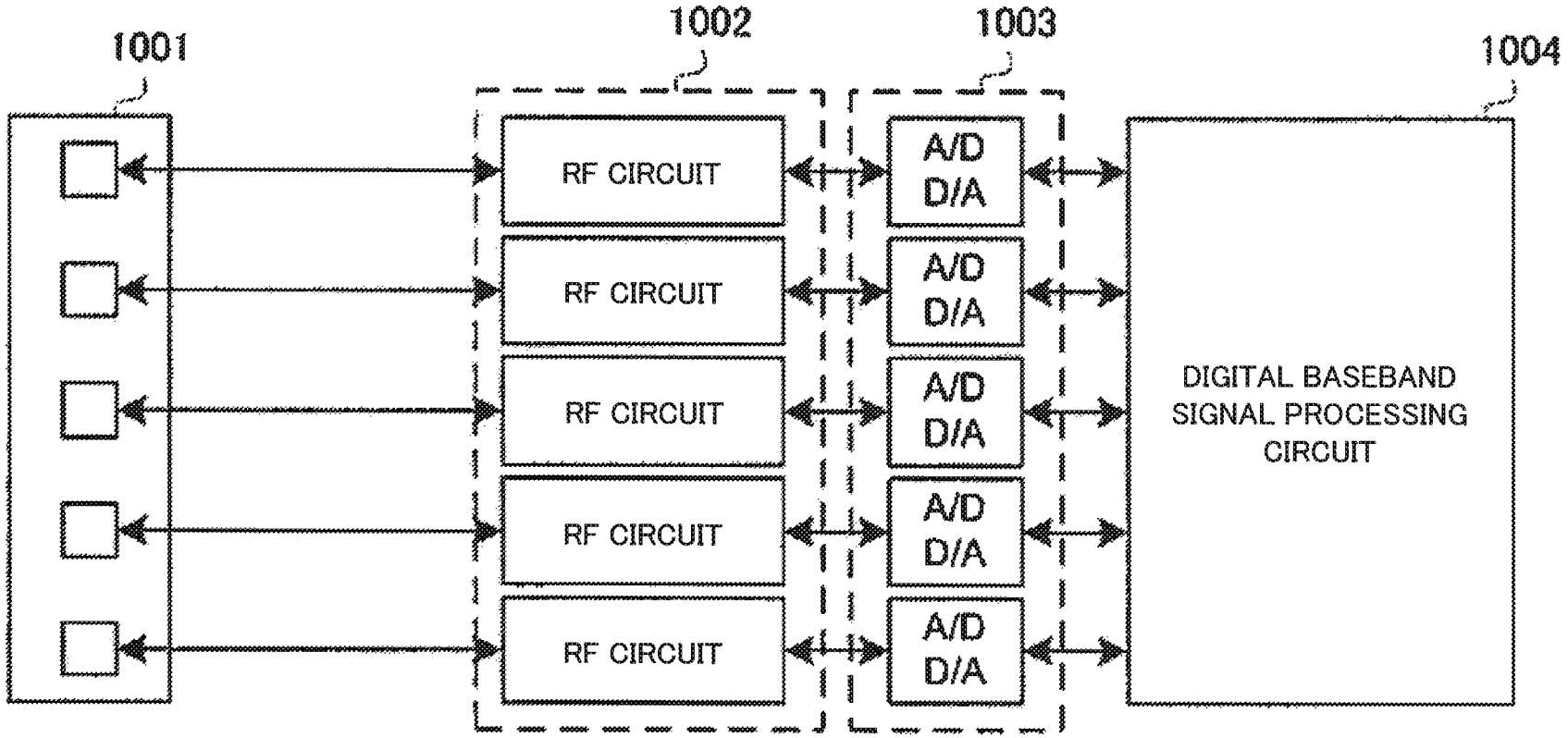
FIG. 10 is a diagram illustrating a configuration example of a wireless device upon using a plurality of RF circuits for directivity control of a patch array antenna as a related technique of the present invention.
Figure 11:
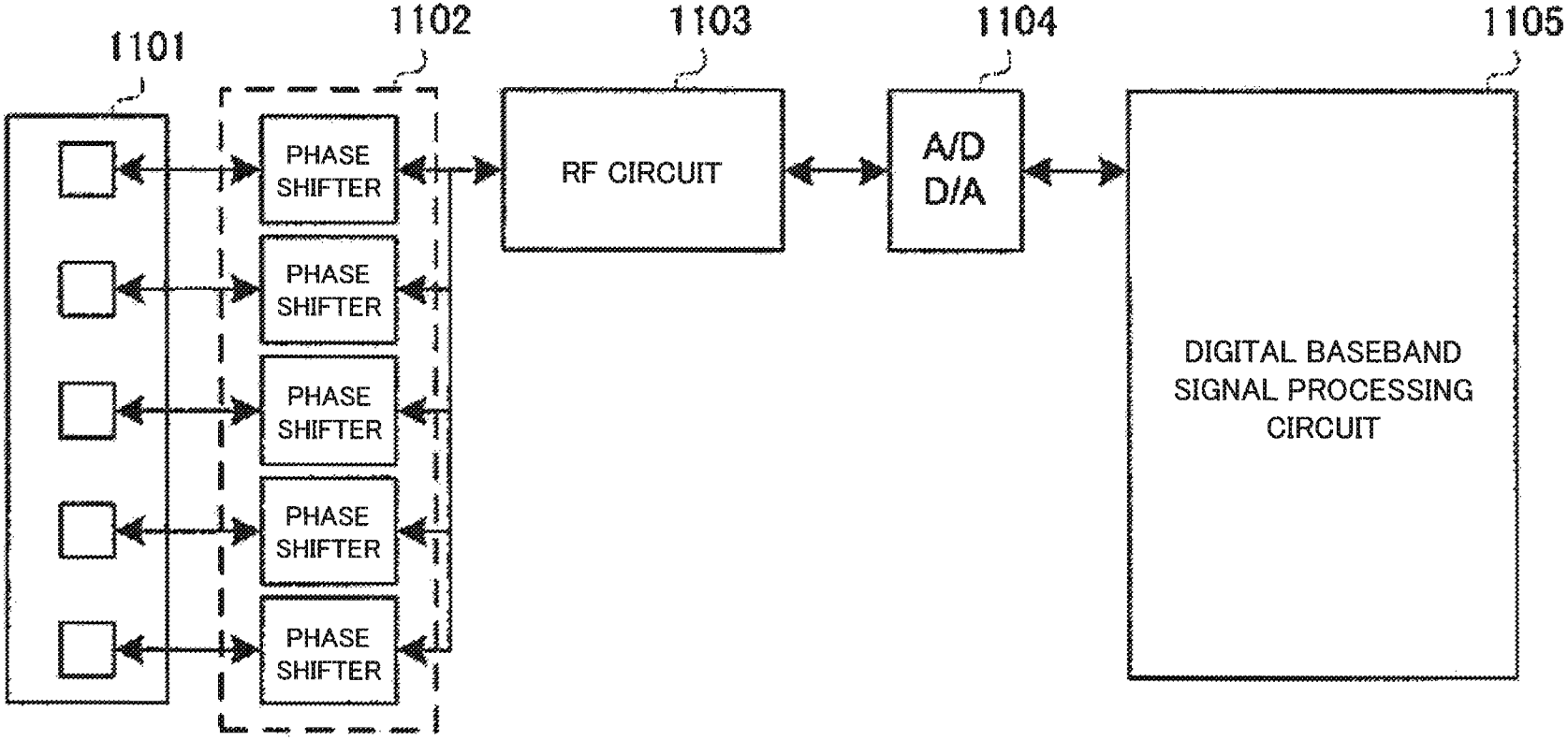
FIG. 11 is a diagram illustrating a configuration example of a wireless device upon using a plurality of phase shifters for directivity control of a patch array antenna as a related technique of the present invention.

FIGS. 10 and 11 each illustrate a configuration example of a wireless device using a patch array antenna according to a related technique.

FIG. 10 illustrates a wireless device including a configuration in which a series circuit of an RF circuit 1002 and an A/D converter and D/A converter 1003 is connected between a plurality of antenna elements of a patch array antenna 1001 and a plurality of input/output units of a digital baseband signal processing circuit 1004, respectively. In the wireless device, in the digital baseband signal processing circuit 1004, a phase of a signal output to each antenna element is controlled.

The wireless device illustrated in FIG. 11 includes a configuration in which a phase shifter 1102 is connected to each of a plurality of antenna elements of a patch array antenna 1101 and a series circuit of an RF circuit 1103 and an A/D converter and D/A converter 1104 is connected between a plurality of phase shifters 1102 and a digital baseband signal processing circuit 1105. In the wireless device, a voltage applied to each phase shifter 1102 is controlled by the digital baseband signal processing circuit 1105, but illustration of signal wiring therefor is omitted.

The wireless device illustrated in FIG. 10 needs RF circuits 1002 corresponding to the number of antenna elements, and the wireless device illustrated in FIG. 11 needs phase shifters 1102 corresponding to the number of antenna elements. Therefore, in any of the wireless devices of FIGS. 10 and 11, a circuit size is increased, compared to a wireless device using the patch array antenna according to the present invention.

As described above, in the patch array antenna according to the example embodiment of the present invention, a first distribution ratio of a first high-frequency signal fed from a first unequal distribution circuit to a plurality of antenna elements is set to be monotone increasing (or monotone decreasing) with respect to a row of the plurality of antenna elements. On the other hand, a second distribution ratio of a second high-frequency signal fed from a second unequal distribution circuit to a plurality of antenna elements is set to be monotone decreasing (or monotone increasing) with respect to the row of the plurality of antenna elements. In addition, a configuration is made in such a way that a phase difference between the first and second high-frequency signals (input signals) provided to first and second power feeding points can be changed. According to the patch array antenna, directivity can be electrically controlled for a first direction that is an arrangement direction of a plurality of antenna elements. In addition, the patch array antenna can be achieved at low cost since an increase of the number of active components (a RF circuit, a phase shifter and the like) is limited even when the number of antenna elements is increased, and also has high durability.

Examples

Figure 12:
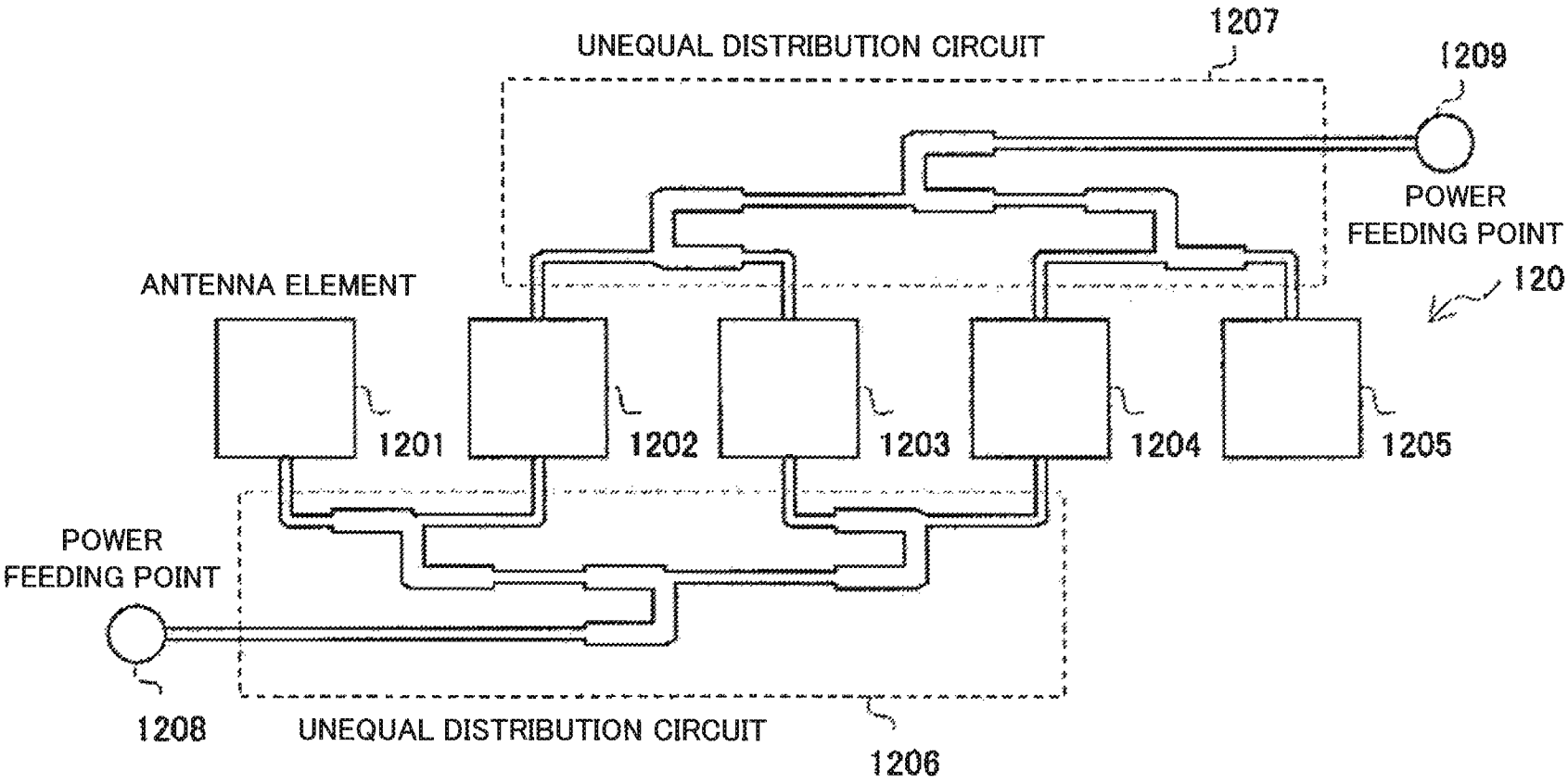
FIG. 12 is a diagram illustrating a first example of the patch array antenna according to the present invention.

FIG. 12 illustrates a first example of the patch array antenna according to the present invention. A patch array antenna 120 thereof includes a pattern in which each of first and second unequal distribution circuits 1206 and 1207 is illustrated in a frame indicated by a dotted line. In the first unequal distribution circuit 1206, a wiring distance of a first microstrip line from a first power feeding point 1208 to first to fourth antenna elements 1201 to 1204 that are feeding targets is constant. Similarly, in the second unequal distribution circuit 1207, a wiring distance of a second microstrip line from a second power feeding point 1209 to second to fifth antenna elements 1202 to 1205 that are feeding targets is constant. In the first and second unequal distribution circuits 1206 and 1207, in order to match impedances and achieve first and second distribution ratios determined, patterns of the first and second microstrip lines are formed as follows.

A distribution ratio of an unequal distribution circuit can be determined by a ratio of wiring widths (thicknesses) at a branch point of wiring. A power of a second high-frequency signal provided from the second power feeding point 1209 is distributed, for example, in such a way as to be larger in a side of the fourth and fifth antenna elements 1204 and 1205 than in a side of the second and third antenna elements 1202 and 1203 at a first branch point of the second unequal distribution circuit 1207. When, for example, a distribution ratio of the first branch point is 1:X, a distribution ratio of a second branch point of a left side is 1:Y, and a distribution ratio of a second branch point of a right side is 1:Z, a distribution ratio is 1×1 for the antenna element 1202, 1×Y for the antenna element 1203, X×1 for the antenna element 1204, and X×Z for the antenna element 1205. The X, Y, and Z are adjusted, and thereby a distribution ratio determined by a circular interpolation method or a linear interpolation method is achieved. While in FIG. 12, wirings at branch points appear to have the same thickness, actually, a ratio of thicknesses of wirings is changed for each branch point. This is the same as in a patch array antenna next illustrated in FIG. 13.

Figure 13:
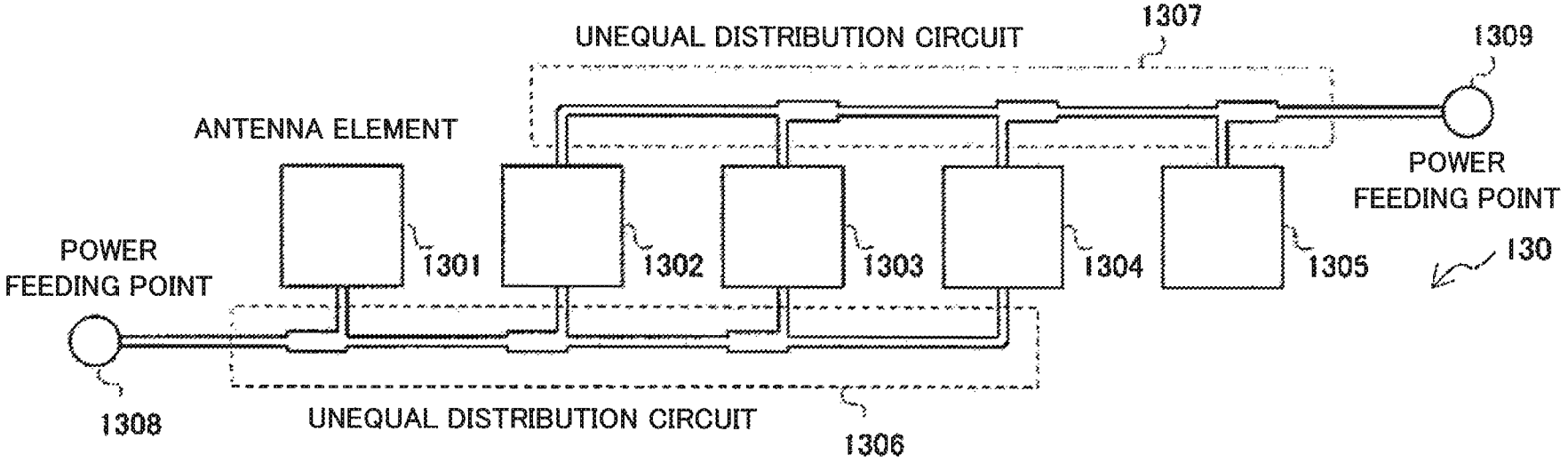
FIG. 13 is a diagram illustrating a second example of the patch array antenna according to the present invention.

FIG. 13 illustrates a second example of the patch array antenna according to the present invention. In a first unequal distribution circuit 1306, a pattern which is a wiring distance of a first micro strip line from a first power feeding point 1308 to first to fourth antenna elements 1301 to 1304 that are power feeding targets is different depending on a position of each antenna element. In a second unequal distribution circuit 1307, a pattern, i.e. a wiring distance here, of a second microstrip line from a second power feeding point 1309 to second to fifth antenna elements 1302 to 1305 that are power feeding targets is different depending on a position of each antenna element. In a patch array antenna 130 according to the second example, even when a phase difference of first and second high-frequency signals between the first and second power feeding points 1308 and 1309 is constant, beam directional angles are different depending on frequencies of the first and second high-frequency signals, and therefore in consideration thereof, directivity can be controlled.

The patch array antennas of FIGS. 12 and 13 also produce an advantageous effect similar to the advantageous effect described in the example embodiment.

Figure 14:
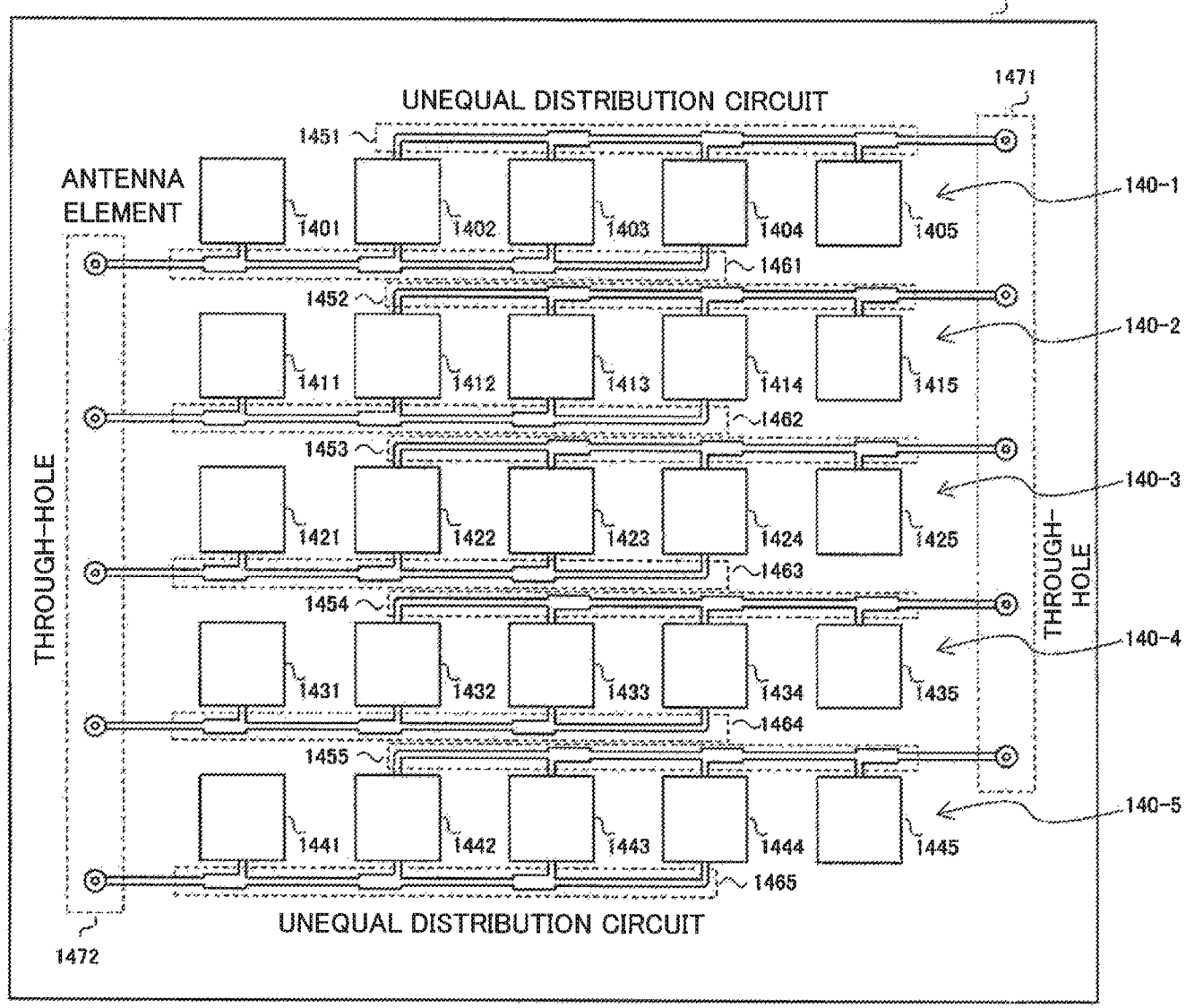
FIG. 14 is a diagram in which an example obtained by applying the patch array antenna according to the present invention to a two-dimensional array antenna is viewed from an antenna plane side.
Figure 15:
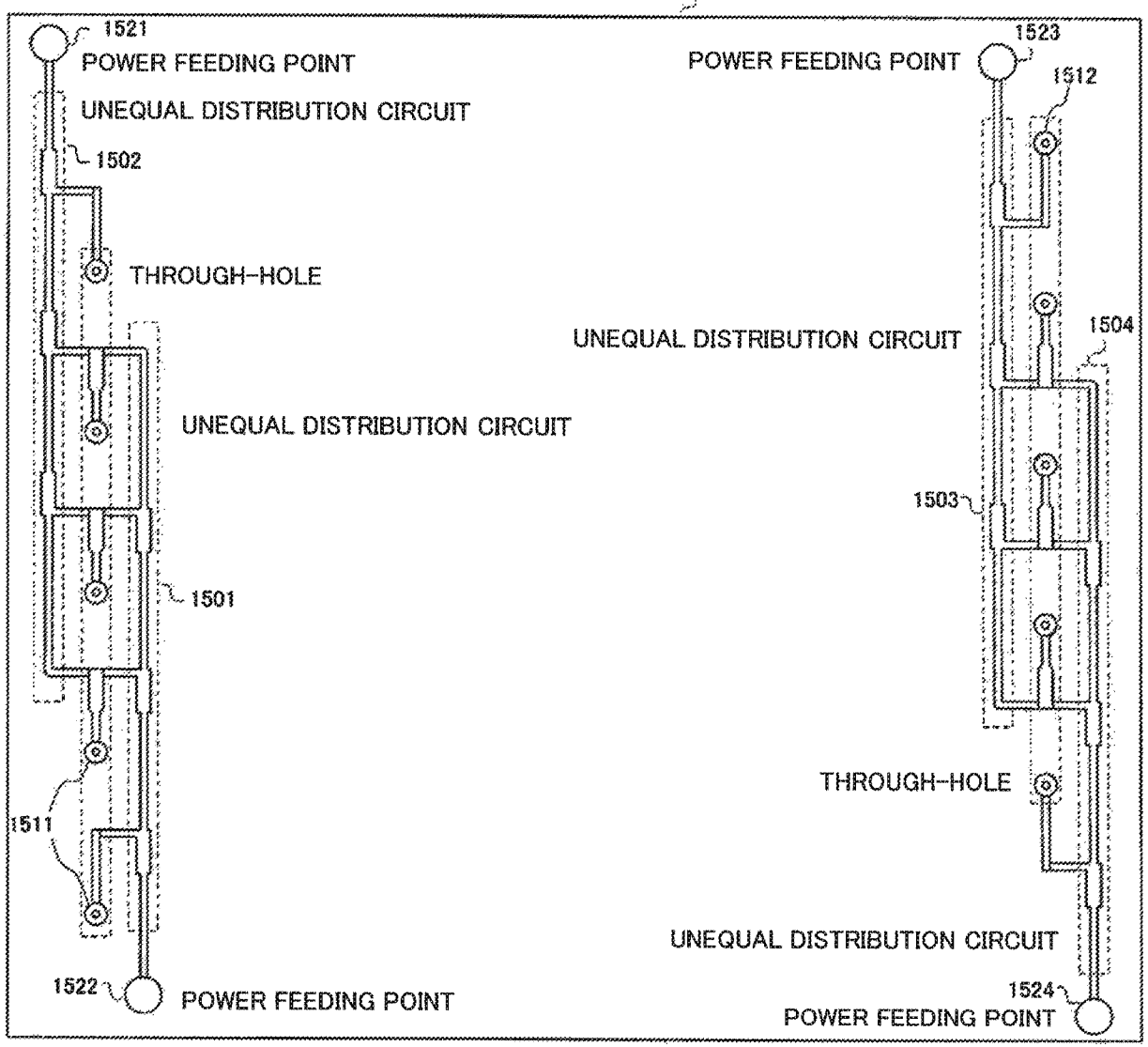
FIG. 15 is a diagram in which the two-dimensional array antenna illustrated in FIG. 14 is viewed from a back-surface side opposite to the antenna plane.

FIGS. 14 and 15 each illustrate an example in which of the patch array antennas according to the present invention, the patch array antenna illustrated in FIG. 13 is applied to a two-dimensional array antenna. The two-dimensional array antenna uses a multilayer dielectric substrate 1400 including a pattern for each of a surface and a back surface.

FIG. 14 illustrates a pattern of an antenna plane (surface) of a two-dimensional array antenna. On the surface side of the dielectric substrate 1400, first to fifth patch array antennas 140-1 to 140-5 are formed side by side in a second direction (vertical direction) orthogonal to a first direction. On the surface side of the dielectric substrate 1400, further, five through-holes 1472 arranged in the second direction are formed adjacently to the first to fifth patch array antennas 140-1 to 140-5 on a third side parallel to the second direction. The five through-holes 1472 act as first power feeding points for providing first high-frequency signals to the first to fifth patch array antennas 140-1 to 140-5, respectively. On the surface side of the dielectric substrate 1400, further, five through-holes 1471 arranged in the second direction are formed adjacently to the first to fifth patch array antennas 140-1 to 140-5 on a fourth side parallel to the second direction. The five through-holes 1471 act as second power feeding points for providing second high-frequency signals to the first to fifth patch array antennas 140-1 to 140-5, respectively. While in FIG. 14, the number of patch array antennas L is 5, the number of patch array antennas L can be an integer equal to or more than 3.

FIG. 15 illustrates a diagram in which a pattern of the back surface of a two-dimensional array antenna is seen through from the surface side illustrated in FIG. 14. On the back-surface side of the dielectric substrate 1400, third and fourth power feeding points 1521 and 1522 and third and fourth unequal distribution circuits 1502 and 1501 are formed on one side of the first direction. On the back-surface side of the dielectric substrate 1400, further, fifth and sixth power feeding points 1523 and 1524 and fifth and sixth unequal distribution circuits 1503 and 1504 are formed on the other side of the first direction. The third to sixth unequal distribution circuits can be configured by a wiring pattern as described in FIGS. 12 and 13.

For detailed description, on the back-surface side of the dielectric substrate 1400, five through-holes 1511 are formed side by side in the second direction on one side of the first direction. The third unequal distribution circuit 1502 is formed along one side of both sides along the five through-holes 1511. The third unequal distribution circuit 1502 distributes a third high-frequency signal fed from the third power feeding point 1521 to the five through-holes 1511. Further, the fourth unequal distribution circuit 1501 is formed along the other side of both sides along the five through-holes 1511. The fourth unequal distribution circuit 1501 distributes a fourth high-frequency signal fed from the fourth power feeding point 1522 to the five through-holes 1511.

On the back-surface side of the dielectric substrate 1400, further, five through-holes 1512 are formed side by side in the second direction on the other side of the first direction. The fifth unequal distribution circuit 1503 is formed along one side of both sides along the five through-holes 1512. The fifth unequal distribution circuit 1503 distributes a fifth high-frequency signal fed from the fifth power feeding point 1523 to the five through-holes 1512. Further, the sixth unequal distribution circuit 1504 is formed along the other side of both sides along the five through-holes 1512. The sixth unequal distribution circuit 1504 distributes a sixth high-frequency signal fed from the sixth power feeding point 1524 to the five through-holes 1512. The third to sixth high-frequency signals have the same frequency and amplitude and different phases.

In this example, third and fourth high-frequency signals (input signals) provided to the third and fourth power feeding points 1521 and 1522 of the back-surface side illustrated in FIG. 15 are distributed to the five through-holes 1511 at third and fourth power distribution ratios (third and fourth distribution ratios) by the third and fourth unequal distribution circuits 1502 and 1501 of the back-surface side, respectively. The five through-holes 1511 each act as a first relay means (first through-hole) configured to synthesize distributed signals from the third and fourth unequal distribution circuits 1502 and 1501 and transmit the synthesized signal to the surface side of the dielectric substrate 1400. For example, a third distribution ratio of the third unequal distribution circuit 1502 can be set to be one of monotone increasing and monotone decreasing with respect to a row of the five through-holes 1511. In this case, a fourth distribution ratio of the fourth unequal distribution circuit 1501 is set to be the other of monotone increasing and monotone decreasing with respect to the row of the five through-holes 1511.

Similarly, fifth and sixth high-frequency signals (input signals) provided to the fifth and sixth power feeding points 1523 and 1524 of the back-surface side illustrated in FIG. 15 are distributed to the five through-holes 1512 at fifth and sixth power distribution ratios (fifth and sixth distribution ratios) by the fifth and sixth unequal distribution circuits 1503 and 1504 of the back-surface side, respectively. The five through-holes 1512 each act as a second relay means (second through-hole) configured to synthesize distributed signals from the fifth and sixth unequal distribution circuits 1503 and 1504 and transmit the synthesized signal to the surface side of the dielectric substrate 1400. For example, a fifth distribution ratio of the fifth unequal distribution circuit 1503 can be set to be one of monotone increasing and monotone decreasing with respect to a row of the five through-holes 1512. In this case, a sixth distribution ratio of the sixth unequal distribution circuit 1504 is set to be the other of monotone increasing and monotone decreasing with respect to the row of the five through-holes 1512.

Synthesized signals from the five through-holes 1511 and 1512 are signals having a constant phase difference for the respective through-holes.

In this example, two sets of a combination of two power feeding points and two unequal distribution circuits are prepared and disposed on both end sides of one direction (a lateral direction) of the back surface of the dielectric substrate 1400, but these may be disposed on the surface side of the dielectric substrate 1400.

In FIG. 14, five through-holes 1472 of the left side correspond to five through-holes 1511 of the back-surface side, and five through-holes 1471 of the right side correspond to five through-holes 1512 of the back-surface side. Thereby, synthesized signals from the five through-holes 1511 of the back-surface side are propagated to the five through-holes (first power feeding points) 1472 of the antenna plane side as first high-frequency signals, respectively. Similarly, synthesized signals from the five through-holes 1512 of the back-surface side are propagated to the five through-holes (second power feeding points) 1471 of the antenna plane side as second high-frequency signals, respectively.

The pattern of the antenna plane of FIG. 14 is a pattern in which five patch array antennas of FIG. 13 are arranged in a vertical direction. Therefore, five through-holes that are power feeding points to an unequal distribution circuit for respective patch array antennas are also formed side by side in a vertical direction on each of both sides of the dielectric substrate 1400.

A first high-frequency signal provided from a through-hole 1472 of a first stage from the top on the left side of the antenna plane side is distributed to a lower end side of first to fifth antenna elements 1401 to 1405 through a first unequal distribution circuit 1461. However, a distribution ratio of the antenna element 1405 is 0. On the other hand, a second high-frequency signal provided from a through-hole 1471 of a first stage from the top on the right side of the antenna plane side is distributed to an upper end side of the first to fifth antenna elements 1401 to 1405 through a second unequal distribution circuit 1451. However, a distribution ratio of the antenna element 1401 is 0. As described in FIGS. 1 and 13, when a first distribution ratio based on the first unequal distribution circuit 1461 is set to be monotone decreasing with respect to a row of a plurality of antenna elements, a second distribution ratio based on the second unequal distribution circuit 1451 is set to be monotone increasing with respect to the row of the plurality of antenna elements.

The first to fifth antenna elements 1401 to 1405 synthesize the distributed first and second high-frequency signals and emit the synthesized signals, respectively.

Similarly, second and third high-frequency signals provided from through-holes 1472 and 1471 of a second stage of the antenna plane side are distributed to first to fifth antenna elements 1411 to 1415 through first and second unequal distribution circuits 1462 and 1452, respectively. The first to fifth antenna elements 1411 to 1415 synthesize the distributed first and second high-frequency signals and emit the synthesized signals, respectively.

A similar case is exactly applied to a third stage, a fourth stage, and a fifth stage, and therefore description thereof will be omitted.

The two-dimensional array antenna controls, using an external control unit (illustration thereof is omitted), phases of third and fourth high-frequency signals input from the third and fourth power feeding points 1521 and 1522 and phases of fifth and sixth high-frequency signals input from the fifth and sixth power feeding points 1523 and 1524 and thereby can control directivity for two directions which are a first direction (lateral direction) and a second direction (vertical direction). When, for example, a phase difference of a signal of the fourth power feeding point 1522 with respect to the third power feeding point 1521 is A and a phase difference of a signal of the fifth power feeding point 1523 with respect to the third power feeding point 1521 is B, a phase difference of a signal of the sixth power feeding point 1524 with respect to the third power feeding point 1521 is (A+B).

In this example, a pattern in which five patch array antennas illustrated in FIG. 13 are arranged in a vertical direction, but it goes without saying that instead of the patch array antenna illustrated in FIG. 13, the patch array antenna illustrated in FIG. 1 or FIG. 12 may be used.

The two-dimensional array antenna according to the present invention includes a configuration in which L patch array antennas described in the examples are arranged in one direction (a vertical direction). The two-dimensional array antenna further includes two sets of a configuration in which two high-frequency signals from two power feeding points are distributed by two unequal distribution circuits, respectively, to L that is the same number of patch array antennas at predetermined distribution ratios, the distributed signals are synthesized, and L synthesized signals are obtained. A configuration is made in such way that L synthesized signals of one set are provided to one of first and second unequal distribution circuits in L patch array antennas, respectively, and L synthesized signals of the other set are provided to the other of the first and second unequal distribution circuits in the L patch array antennas, respectively. Thereby, it is possible that an advantageous effect of the patch array antenna described in the example embodiment is produced and a two-dimensional array antenna capable of controlling directivity for two direction that are a lateral direction and a vertical direction is provided.

A specific configuration of the present invention is not limited to the above-described example embodiment and examples, and is included in the present invention even when a modification without departing from the gist of the present invention is made.

Further, a part or all of the example embodiment and examples can be described as follows. The following supplementary notes do not limit the present invention.

[Supplementary Note 1]

A patch array antenna including:

first to Nth (N is an integer equal to or more than 3) antenna elements formed side by side on a dielectric substrate in a first direction;

a first unequal distribution circuit that is formed on the dielectric substrate in the first direction adjacently to the first to Nth antenna elements on a first side and distributes a first high-frequency signal fed from a first power feeding point to the first to Nth antenna elements; and a second unequal distribution circuit that is formed on the dielectric substrate in the first direction adjacently to the first to Nth antenna elements on a second side opposite to the first side and distributes a second high-frequency signal fed from a second power feeding point to the first to Nth antenna elements, wherein in the first unequal distribution circuit, a first distribution ratio of a power of the first high-frequency signal to be distributed from the first power feeding point to the first to Nth antenna elements is set to be one of monotone increasing and monotone decreasing with respect to a row of the first to Nth antenna elements, in the second unequal distribution circuit, a second distribution ratio of a power of the second high-frequency signal to be distributed from the second feeding point to the first to Nth antenna elements is set to be the other of monotone increasing and monotone decreasing with respect to the row of the first to Nth antenna elements, and directivity is controlled by changing a phase difference between the first and second high-frequency signals.

[Supplementary Note 2]

The patch array antenna according to supplementary note 1, wherein in the first and second unequal distribution circuits, the first and second distribution ratios are set in such a way that a total of powers of signals resulting from distribution of the first and second high-frequency signals fed from the first and second power feeding points, respectively, to the first to Nth antenna elements is constant in each of the first to Nth antenna elements, and a phase difference between adjacent antenna elements of signals to be synthesized in each antenna element is constant.

[Supplementary Note 3]

The patch array antenna according to supplementary note 1, wherein in the first and second unequal distribution circuits, the first and second distribution ratios are set in such a way that a total of amplitudes of signals resulting from distribution of the first and second high-frequency signals fed from the first and second power feeding points, respectively, to the first to Nth antenna elements is constant in each of the first to Nth antenna elements, and a phase difference between adjacent antenna elements of signals to be synthesized in each antenna element is constant.

[Supplementary Note 4]

The patch array antenna according to any one of supplementary notes 1 to 3, wherein in the first and second unequal distribution circuits, the first and second distribution ratios are respectively determined by a circular interpolation method or a linear interpolation method.

[Supplementary Note 5]

The patch array antenna according to any one of supplementary notes 1 to 4, wherein in the first and second unequal distribution circuits, the first and second distribution ratios are respectively achieved based on patterns of first and second microstrip lines configuring the first and second unequal distribution circuits, and wiring distances of the first and second microstrip lines from the first and second power feeding points to the first to Nth antenna elements are constant.

[Supplementary Note 6]

The patch array antenna according to any one of supplementary notes 1 to 4, wherein in the first and second unequal distribution circuits, the first and second distribution ratios are respectively achieved based on patterns of first and second microstrip lines configuring the first and second unequal distribution circuits, and wiring distances of the first and second microstrip lines from the first and second power feeding points to the first to Nth antenna elements are different depending on positions of the first to Nth antenna elements.

[Supplementary Note 7]

A directivity control method for a patch array antenna including: first to Nth (N is an integer equal to or more than 3) antenna elements formed side by side on a dielectric substrate in a first direction; a first unequal distribution circuit that is formed on the dielectric substrate in the first direction adjacently to the first to Nth antenna elements on a first side and distributes a first high-frequency signal fed from a first power feeding point to the first to Nth antenna elements; and a second unequal distribution circuit that is formed on the dielectric substrate in the first direction adjacently to the first to Nth antenna elements on a second side opposite to the first side and distributes a second high-frequency signal fed from a second power feeding point to the first to Nth antenna elements, the method including:

setting, in the first unequal distribution circuit, a first distribution ratio of a power of the first high-frequency signal to be distributed from the first power feeding point to the first to Nth antenna elements to be one of monotone increasing and monotone decreasing with respect to a row of the first to Nth antenna elements; setting, in the second unequal distribution circuit, a second distribution ratio of a power of the second high-frequency signal to be distributed from the second power feeding point to the first to Nth antenna elements to be the other of monotone increasing and monotone decreasing with respect to the row of the first to Nth antenna elements; and controlling directivity by changing a phase difference between the first and second high-frequency signals.

[Supplementary Note 8]

The directivity control method for the patch array antenna according to supplementary note 7, the method including setting, in the first and second unequal distribution circuits, the first and second distribution ratios in such a way that a total of powers of signals resulting from distribution of the first and second high-frequency signals fed from the first and second power feeding points, respectively, to the first to Nth antenna elements is constant in each of the first to Nth antenna elements, and a phase difference between adjacent antenna elements of signals to be synthesized in each antenna element is constant.

[Supplementary Note 9]

The directivity control method for the patch array antenna according to supplementary note 7, the method including setting, in the first and second unequal distribution circuits, the first and second distribution ratios in such a way that a total of amplitudes of signals resulting from distribution of the first and second high-frequency signals fed from the first and second power feeding points, respectively, to the first to Nth antenna elements is constant in each of the first to Nth antenna elements, and a phase difference between adjacent antenna elements of signals to be synthesized in each antenna element is constant.

[Supplementary Note 10]

A wireless device including:

a control unit;

a patch array antenna according to any one of supplementary notes 1 to 6; and first and second RF circuits connected between the first and second power feeding points of the patch array antenna and the control unit, respectively, wherein a phase difference between the first and second high-frequency signals to be provided to the first and second power feeding points is changed by the control unit through the first and second RF circuits.

[Supplementary Note 11]

A wireless device including:

a control unit;

a patch array antenna according to any one of supplementary notes 1 to 6;

first and second phase shifters one end sides of which are connected to the first and second power feeding points of the patch array antenna, respectively; and an RF circuit commonly connected between the other end sides of the first and second phase shifters and the control unit, wherein a phase difference between the first and second high-frequency signals to be provided to the first and second power feeding points is changed by controlling the first and second phase shifters by the control unit.

[Supplementary Note 12]

A two-dimensional array antenna including first to Lth (L is an integer equal to or more than 3) patch array antennas obtained by disposing a patch array antenna according to any one of supplementary notes 1 to 6 side by side on a dielectric substrate in a second direction orthogonal to the first direction, the two-dimensional array antenna including: L of the first power feeding points arranged in the second direction adjacently to the first to Lth patch array antennas on a third side parallel to the second direction; and L of the second power feeding points arranged in the second direction adjacently to the first to Lth patch array antennas on a fourth side opposite to the third side, the two-dimensional array antenna further including: a third unequal distribution circuit that is formed along one side of both sides along the L first power feeding points and distributes a third high-frequency signal fed from a third power feeding point to the L first power feeding points;

a fourth unequal distribution circuit that is formed along the other side of both sides along the L first power feeding points and distributes a fourth high-frequency signal fed from a fourth power feeding point to the L first power feeding points;

a fifth unequal distribution circuit that is formed along one side of both sides along the L second power feeding points and distributes a fifth high-frequency signal fed from a fifth power feeding point to the L second power feeding points; and a sixth unequal distribution circuit that is formed along the other side of both sides along the L second power feeding points and distributes a sixth high-frequency signal fed from a sixth power feeding point to the L second power feeding points, wherein a distributed signal of the third high-frequency signal from the third unequal distribution circuit and a distributed signal of the fourth high-frequency signal from the fourth unequal distribution circuit are synthesized at the L first power feeding points, respectively, and fed to the first to Lth patch array antennas as the first high-frequency signal, a distributed signal of the fifth high-frequency signal from the fifth unequal distribution circuit and a distributed signal of the sixth high-frequency signal from the sixth unequal distribution circuit are synthesized at the L second power feeding points, respectively, and fed to the first to Lth patch array antennas as the second high-frequency signal, and a phase difference between the third and fourth high-frequency signals from the third and fourth power feeding points and a phase difference between the fifth and sixth high-frequency signals from the fifth and sixth power feeding points are changed.

[Supplementary Note 13]

The two-dimensional array antenna according to supplementary note 12, wherein in the third and fifth unequal distribution circuits, third and fifth distribution ratios of powers of the third and fifth high-frequency signals, respectively, to be distributed to the L first and second power feeding points are set to be one of monotone increasing and monotone decreasing with respect to a row of the L first and second power feeding points, and in the fourth and sixth unequal distribution circuits, fourth and sixth distribution ratios of powers of the fourth and sixth high-frequency signals, respectively, to be distributed to the L first and second power feeding points are set to be the other of monotone increasing and monotone decreasing with respect to the row of the L first and second power feeding points.

[Supplementary Note 14]

The two-dimensional array antenna according to supplementary note 12 or 13, wherein the first to Lth patch array antennas, the L first power feeding points, and the L second power feeding points are formed on one surface side of the dielectric substrate, on the other surface side of the dielectric substrate opposite to the one surface side, L first through-holes connected to the L first power feeding points are formed in portions corresponding to the L first power feeding points and the third and fourth unequal distribution circuits are formed on both sides along the L first through-holes, and on the other surface side of the dielectric substrate opposite to the one surface side, L second through-holes connected to the L second power feeding points are formed in portions corresponding to the L second power feeding points and the fifth and sixth unequal distribution circuits are formed on both sides along the L second through-holes.

The present invention has been described using the above-described example embodiment as a typical example. However, the present invention is not limited to the above-described example embodiment. In other words, the present invention can be applied with various forms that can be understood by those skilled in the art, without departing from the scope of the present invention.

This application is based upon and claims the benefit of priority from Japanese patent application No. 2015-202636, filed on Oct. 14, 2015, the disclosure of which is incorporated herein in its entirety by reference.

REFERENCE SIGNS LIST

101 to 105 Antenna element
106, 107 Unequal distribution circuit
108, 109 Power feeding point
301 to 305 Synthesized signal vector
401 to 405 Synthesized signal vector
501 to 505 Synthesized signal vector
601 to 605 Synthesized signal vector
801 Patch array antenna
802-1, 802-2 RF circuit
803-1, 803-2 A/D converter and D/A converter
804 Digital baseband signal processing circuit
901 Patch array antenna
902-1, 902-2 Phase shifter
903 RF circuit
904 A/D converter and D/A converter
905 Digital baseband signal processing circuit
1001 Patch array antenna
1002 RF circuit
1003 A/D converter and D/A converter
1004 Digital baseband signal processing circuit
1101 Patch array antenna
1102 Phase shifter
1103 RF circuit
1104 A/D converter and D/A converter
1105 Digital baseband signal processing circuit
1201 to 1205 Antenna element
1206, 1207 Unequal distribution circuit
1208, 1209 Power feeding point
1301 to 1305 Antenna element
1306, 1307 Unequal distribution circuit
1308, 1309 Power feeding point
1400 Dielectric substrate

1451 to 1455 Unequal distribution circuit
1461 to 1465 Unequal distribution circuit
1471, 1472 Through-hole
1501, 1502, 1503, 1504 Unequal distribution circuit
1511, 1512 Through-hole
1521, 1522, 1523, 1524 Power feeding point

What is claimed is:

1. A patch array antenna comprising:

first to Nth (N is an integer equal to or more than 3) antenna elements being formed side by side on a dielectric substrate in a first direction;

a first unequal distribution circuit that is formed on the dielectric substrate in the first direction adjacently to the first to Nth antenna elements on a first side and distributes a first high-frequency signal fed from a first power feeding point to the first to Nth antenna elements; and a second unequal distribution circuit that is formed on the dielectric substrate in the first direction adjacently to the first to Nth antenna elements on a second side opposite to the first side and distributes a second high-frequency signal fed from a second power feeding point to the first to Nth antenna elements, wherein, in the first unequal distribution circuit, a first distribution ratio of a power of the first high-frequency signal to be distributed from the first power feeding point to the first to Nth antenna elements is set to be one of monotone increasing and monotone decreasing with respect to a row of the first to Nth antenna elements, in the second unequal distribution circuit, a second distribution ratio of a power of the second high-frequency signal to be distributed from the second feeding point to the first to Nth antenna elements is set to be another of monotone increasing and monotone decreasing with respect to a row of the first to Nth antenna elements, and directivity is controlled by changing a phase difference between the first and second high-frequency signals.

2. The patch array antenna according to claim 1, wherein, in the first and second unequal distribution circuits, the first and second distribution ratios are set in such a way that a total of powers of signals resulting from distribution of the first and second high-frequency signals fed from the first and second power feeding points, respectively, to the first to Nth antenna elements is constant in each of the first to Nth antenna elements, and a phase difference between adjacent antenna elements of signals to be synthesized in each antenna element is constant.

3. The patch array antenna according to claim 1, wherein, in the first and second unequal distribution circuits, the first and second distribution ratios are set in such a way that a total of amplitudes of signals resulting from distribution of the first and second high-frequency signals fed from the first and second power feeding points, respectively, to the first to Nth antenna elements is constant in each of the first to Nth antenna elements, and a phase difference between adjacent antenna elements of signals to be synthesized in each antenna element is constant.

4. The patch array antenna according to claim 1, wherein, in the first and second unequal distribution circuits, the first and second distribution ratios are respectively determined by a circular interpolation method or a linear interpolation method.

5. The patch array antenna according to claim 1, wherein, in the first and second unequal distribution circuits, the first and second distribution ratios are respectively achieved based on patterns of first and second microstrip lines constituting the first and second unequal distribution circuits, and wiring distances of the first and second microstrip lines from the first and second power feeding points to the first to Nth antenna elements are constant.

6. The patch array antenna according to claim 1, wherein, in the first and second unequal distribution circuits, the first and second distribution ratios are respectively achieved based on patterns of first and second microstrip lines constituting the first and second unequal distribution circuits, and wiring distances of the first and second microstrip lines from the first and second power feeding points to the first to Nth antenna elements are different depending on positions of the first to Nth antenna elements.

7. A directivity control method for a patch array antenna including:

first to Nth (N is an integer equal to or more than 3) antenna elements being formed side by side on a dielectric substrate in a first direction;

a first unequal distribution circuit that is formed on the dielectric substrate in the first direction adjacently to the first to Nth antenna elements on a first side and distributes a first high-frequency signal fed from a first power feeding point to the first to Nth antenna elements; and a second unequal distribution circuit that is formed on the dielectric substrate in the first direction adjacently to the first to Nth antenna elements on a second side opposite to the first side and distributes a second high-frequency signal fed from a second power feeding point to the first to Nth antenna elements, the method comprising:

setting, in the first unequal distribution circuit, a first distribution ratio of a power of the first high-frequency signal to be distributed from the first power feeding point to the first to Nth antenna elements, to be one of monotone increasing and monotone decreasing with respect to a row of the first to Nth antenna elements;

setting, in the second unequal distribution circuit, a second distribution ratio of a power of the second high-frequency signal to be distributed from the second power feeding point to the first to Nth antenna elements, to be another of monotone increasing and monotone decreasing with respect to a row of the first to Nth antenna elements; and controlling directivity by changing a phase difference between the first and second high-frequency signals.

8. A wireless device comprising:

a control unit;

the patch array antenna according to claim 1; and first and second RF circuits connected between the first and second power feeding points of the patch array antenna and the control unit, respectively, wherein a phase difference between the first and second high-frequency signals to be provided to the first and second power feeding points is changed by the control unit through the first and second RF circuits.

9. A wireless device comprising:

a control unit;

the patch array antenna according to claim 1;

first and second phase shifters one end sides of which are connected to the first and second power feeding points of the patch array antenna, respectively; and an RF circuit commonly connected between another end sides of the first and second phase shifters and the control unit, wherein a phase difference between the first and second high-frequency signals to be provided to the first and second power feeding points is changed by controlling the first and second phase shifters by the control unit.

10. A two-dimensional array antenna comprising first to Lth (L is an integer equal to or more than 3) patch array antennas obtained by disposing the patch array antenna according to claim 1 side by side on a dielectric substrate in a second direction orthogonal to the first direction, the two-dimensional array antenna further comprising: L of the first power feeding points arranged in the second direction adjacently to the first to Lth patch array antennas on a third side parallel to the second direction; and L of the second power feeding points arranged in the second direction adjacently to the first to Lth patch array antennas on a fourth side opposite to the third side, the two-dimensional array antenna further comprising:

a third unequal distribution circuit that is formed along one side of both sides along the L first power feeding points and distributes a third high-frequency signal fed from a third power feeding point to the L first power feeding points;

a fourth unequal distribution circuit that is formed along another side of both sides along the L first power feeding points and distributes a fourth high-frequency signal fed from a fourth power feeding point to the L first power feeding points;

a fifth unequal distribution circuit that is formed along one side of both sides along the L second power feeding points and distributes a fifth high-frequency signal fed from a fifth power feeding point to the L second power feeding points; and a sixth unequal distribution circuit that is formed along another side of both sides along the L second power feeding points and distributes a sixth high-frequency signal fed from a sixth power feeding point to the L second power feeding points, wherein a distributed signal of the third high-frequency signal from the third unequal distribution circuit and a distributed signal of the fourth high-frequency signal from the fourth unequal distribution circuit are synthesized at the L first power feeding points, respectively, and fed to the first to Lth patch array antennas as the first high-frequency signal, a distributed signal of the fifth high-frequency signal from the fifth unequal distribution circuit and a distributed signal of the sixth high-frequency signal from the sixth unequal distribution circuit are synthesized at the L second power feeding points, respectively, and fed to the first to Lth patch array antennas as the second high-frequency signal, and a phase difference between the third and fourth high-frequency signals from the third and fourth power feeding points and a phase difference between the fifth and sixth high-frequency signals from the fifth and sixth power feeding points are changed.

* * * * *